United States Patent [19]

Deguchi et al.

[11] Patent Number: 4,968,592

[45] Date of Patent: Nov. 6, 1990

[54] DIRECT POSITIVE IMAGE FORMING METHOD COMPRISING DEVELOPING WITH A COMBINATION OF NUCLEATING AGENTS

[75] Inventors: Naoyasu Deguchi; Satoshi Nagaoka; Noriyuki Inoue; Shigeo Hirano, all of Kanagawa, Japan

[73] Assignee: Fuji Photo Film Co., Ltd., Kanagawa, Japan

[21] Appl. No.: 251,423

[22] Filed: Sep. 30, 1988

[30] Foreign Application Priority Data

Sep. 30, 1987 [JP] Japan ..... 62-247476

[51] Int. Cl.[5] ..... G03C 5/24; G03C 1/405

[52] U.S. Cl. ..... 430/378; 430/409; 430/410; 430/598; 430/940

[58] Field of Search ..... 430/264, 378, 409, 410, 430/598, 940

[56] References Cited

U.S. PATENT DOCUMENTS

| | | | |
|---|---|---|---|
| 3,761,276 | 9/1973 | Evans | 430/409 |
| 4,115,122 | 9/1978 | Adachi et al. | 430/598 |
| 4,255,511 | 3/1981 | Hirano et al. | 430/598 |
| 4,276,364 | 6/1981 | Leone | 430/598 |
| 4,323,643 | 4/1982 | Mifune et al. | 430/598 |
| 4,481,285 | 11/1984 | Takagi et al. | 430/598 |
| 4,550,070 | 10/1985 | Miyasaka et al. | 430/598 |
| 4,880,729 | 11/1989 | Heki et al. | 430/410 |

OTHER PUBLICATIONS

Copending Application 07/091913.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A direct positive image forming method comprising development processing an imagewise exposed photographic light-sensitive material comprising a support having thereon at least on photographic emulsion layer containing internal latent image type silver halide grains not having been previously fogged in the presence of a nucleating agent, wherein the nucleating agent comprises at least two kinds of nucleating agents and a ratio of nucleating rates thereof is at least 2.0.

In accordance with the method of the present invention, images having both a low minimum density and an extremely high maximum density can be rapidly and stably obtained using a small amount of nucleating agents.

16 Claims, No Drawings

DIRECT POSITIVE IMAGE FORMING METHOD COMPRISING DEVELOPING WITH A COMBINATION OF NUCLEATING AGENTS

FIELD OF THE INVENTION

The present invention relates to a direct positive image forming method comprising development processing a direct positive silver halide photographic material, after imagewise exposure, in the presence of a nucleating agent.

BACKGROUND OF THE INVENTION

Photographic processes for obtaining direct positive images without employing a reversal processing step or a negative film are well known.

Among direct positive photographic processes, a process for obtaining a direct positive image comprising exposing imagewise an internal latent image type silver halide emulsion not having been previously fogged and the conducting surface development either after a fogging treatment or along with a fogging treatment is preferred from the standpoint of obtaining a relatively high sensitivity.

The term "internal latent image type silver halide photographic emulsion" as used herein means a silver halide photographic emulsion of the type in which light-sensitive nuclei are mainly present in the interior of silver halide grains and a latent image is formed mainly in the interior of the grains by exposure.

With respect to these processes, various techniques have been hitherto known and main techniques include those described, for example, in U.S. Pat. Nos. 2,592,250, 2,466,957, 2,497,875, 2,588,982, 3,317,322, 3,761,266, 3,761,276 and 3,796,577, British Patents Nos. 1,151,363, 1,150,553, 1,011,062, etc.

In order to form direct positive images, either after an internal latent image type silver halide photographic material is subjected to a fogging treatment using a light fogging method or a chemical fogging method or while an internal latent image type silver halide photographic material is being subjected to the fogging treatment, surface color development is conducted, followed by bleaching and fixing (or bleach-fixing), if desired. After fixing, generally, washing with water and/or stabilizing are performed.

In the direct positive image forming method using the fogging treatment, the developing speed is low and a long period of processing time is required as compared with the case of processing conventional negative type photographic materials. Therefore, in order to shorten the processing time, it has been heretofore performed employing a developing solution having a high pH and/or a high temperature. However, it is also generally known that the minimum image density of direct positive images obtained increased when developed at a high pH.

Other methods for increasing the developing speed in direct positive image formation are also known. For example, there is a method to employ a hydroquinone derivative described in U.S. Pat. No. 3,227,552 or a method to employ a mercapto compound having a carboxylic acid group or a sulfonic acid group described in JP-A-60-170843 (the term "JP-A" as used herein means an "unexamined published Japanese patent application"). However, these compounds exhibit only a small effect on the increase in developing speed, and the technique for effectively increasing the maximum density of direct positive image has not been found. Therefore, it has been desired to develop a technique which provides a sufficiently high maximum image density in a short period of time even when processed with a developing solution having a low pH.

In the case wherein nucleating development is performed in the presence of a nucleating agent using a chemical fogging method, it is know to ordinarily employ a quaternary heterocyclic compound or a hydrazine type compound as a nucleating compound.

However, when the quaternary heterocyclic compound is employed alone as a nucleating agent, a minimum image density is apt to increase along with the increase in maximum image density, and its stability under high temperature and high humidity conditions or a high temperature and low humidity conditions is poor, resulting in a decrease in the maximum image density. Further, it has a problem in that its efficiency changes widely depending on the variation of the pH of the developing solution.

On the other hand, when the hydrazine type compound is employed alone as a nucleating agent, the minimum image density increases as described above because of using a high pH condition required to obtain a sufficient maximum density. It has also a further problem in that the developing activity of the developing solution severely decreases.

Although a technique wherein two or more kinds of hydrazine type compounds are employed together is known as described in British Patent No. 2,107,074, the above described problem can not be solved at all by the use of two or more hydrazine type compounds having almost the same nucleating rate.

SUMMARY OF THE INVENTION

Therefore, an object of the present invention is to solve the above described various problems.

More specifically, an object of the present invention is to provide a method of forming a direct positive image having a sufficiently high maximum image density even when an internal latent image type silver halide photographic material which was not previously fogged is subjected to development processing in the presence of a small amount of a nucleating agent so as not to increase the minimum image density.

Another object of the present invention is to provide a method of forming a direct positive color image having both a high maximum image density and a low minimum image density rapidly and stably.

Other objects of the present invention will become apparent from the following description and examples.

These objects of the present invention are attained by a direct positive image forming method comprising development processing an imagewise exposed photographic light-sensitive material comprising a support having thereon at least one photographic emulsion layer containing internal latent image type silver halide grains not having been previously fogged in the presence of a nucleating agent, wherein the nucleating agent comprises at least two kinds of nucleating agents and a ratio of nucleating rates thereof is at least 2.0.

DETAILED DESCRIPTION OF THE INVENTION

It has been surprisingly found that a direct positive image having both a low minimum density and a high maximum density is obtained by employing at least two kinds of nucleating agents wherein a ratio of nucleating rates thereof is at least 2.0 according to the present invention.

The nucleating agents which can be employed in the present invention include those described, for example, in *Research Disclosure,* No. 22534 (January, 1983), pages 50 to 54; ibid., No. 15162 (November, 1976), pages 76 to 77; and ibid., No. 23510 (November, 1983) pages 346 to 352. In the present invention, quaternary heterocyclic compounds represented by general formula (N-I) described below and hydrazine type compounds represented by general formula (N-II) described below are particularly suitably employed.

The difference of the nucleating rates between at least two kinds of nucleating agents according to the present invention in preferably in a range of from about 2 times to about 10,000 times, preferably from about 3 times to about 5,000 times, particularly in a range from about 4 times to about 1,000 times.

The nucleating agent can be incorporated into a direct positive photographic light-sensitive material and/or a development processing solution according to the present invention.

In the present invention, after imagewise exposure, the photographic light-sensitive material may be subjected to light fogging exposure before and/or during development processing.

The ratio of nucleating rates of at least two kinds of nucleating agents is generally from about 2 to about 10,000, preferably from about 3 to about 5,000, and more preferably from about 4 to about 1,000 in the present invention.

The ratio of nucleating rates used in the present invention is determined in the following manner.

PREPARATION OF EMULSION

An aqueous solution of potassium bromide and an aqueous solution of silver nitrate were simultaneously added at 75° C. over a period of about 12 minutes with vigorous stirring to an aqueous gelatin solution containing 0.13 g of 3,4-dimethyl-1,3-thiazoline-2-thion per mol of Ag, to obtain an octahedral monodispersed silver bromide emulsion having an average grain diameter of 0.35 μm. Sodium thiosulate and chloroauric acid (tetrahydrate) were added to the emulsion and the emulsion was heated at 75° C. for 80 minutes to be chemically sensitized. The thus prepared silver bromide grains were used as cores and were treated for a further 40 minutes while adding additional potassium bromide and silver nitrate under the same precipitation conditions described above to be further grown thereby producing finally an octahedral monodispersed core/shell silver bromide emulsion having an average grain diameter of 0.6 μm. The emulsion was washed with water and desalted, then sodium thiosulfate and chloroauric acid (tetrahydrate) were added thereto and the emulsion was heated at 60° C. for 60 minutes to be chemically sensitized thereby producing an internal latent image type silver halide emulsion.

Using the core/shell type internal latent image emulsion, color photographic paper having the layer structure shown below was prepared using a paper support both surfaces of which had been laminated with polyethylene. The coating solutions were prepared as follows.

First Layer 10 g of Cyan coupler (a) was dissolved in a mixture of 10 ml of ethyl acetate and 4 ml of solvent (c) and the solution was emulsified and dispersed in 90 ml of a 10% aqueous glatin solution containing 5 ml of a 10% aqueous solution of sodium dodecylbenzene sulfonate. The emulsified dispersion thus-prepared was mixed with the above described silver halide emulsion, the coating amounts of which were adjusted to have the composition shown below and coated.

Emulsion: 0.4 g/m$^2$ (as silver)
Gelatin: 0.9 g/m$^2$
Cyan coupler (a): $7.5\times10^{-4}$ mol/m$^2$
Nucleating agent

Second Layer

Gelatin: 1.5 g/m$^2$
Polymethyl methacrylate latex particles: 0.05 g/m$^2$

A viscosity increasing agent, a coating acid and a gelatin hardener were further added to the first layer and the second layer respectively.

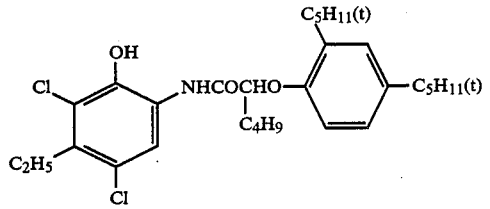

The sample thus prepared was subjected to wedge exposure, then development processing according to the processing steps shown below and a Cyan maximum density of image obtained was measured. Using the above described procedure, a relative ratio of nucleating rates with respect to two kinds of nucleating agents A and B was determined in the following manner. More specifically, reciprocals of mole numbers of the nucleating agents required to provide a Cyan maximum density of 2.0 (NA and NB, respectively) were determined and employed as the ratio of nucleating rates (NA>NB).

| Processing Step | Time | Temperature |
|---|---|---|
| Color development | 1 min 10 sec | 33° C. |
| Bleach-fixing | 40 sec | 33° C. |
| Stabilizing (1) | 20 sec | 33° C. |
| Stabilizing (2) | 20 sec | 33° C. |
| Stabilizing (3) | 20 sec | 33° C. |

The replenishing method of the stabilizing bath was a countercurrent replenishing method, i.e., the replenishing solution was supplied to stabilizing bath (3), the overflow from stabilizing bath (3) was introduced to stabilizing bath (2), and the overflow from stabilizing bath (2) was introduced to stabilizing bath (1).

The composition of each processing solution used was as follows.

| Color Developing Solution | Tank Solution |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |

-continued

| Color Developing Solution | Tank Solution |
|---|---|
| Sodium chloride | 3.20 g |
| 3-Methyl-4-amino-N-ethyl-(β-methane-sulfonamidoethyl) aniline sulfate | 4.25 g |
| Postassium carbonate | 30.0 g |
| Fluorescent brightening agent (stilbene type) | 1.0 g |
| Water to make | 100 ml |
| pH | 10.20 |

The pH was adjusted using potassium hydroxide or hydrochloric acid.

| Bleach-fixing Solution | Tank Solution |
|---|---|
| Ammonium thiosulfate | 110 g |
| Sodium hydrogensulfite | 10 g |
| Ammonium iron (III) diethylenetriaminepentaacetate monohydrate | 56 g |
| Disodium ethylenediaminetetraacetate dihydrate | 5 g |
| Water to make | 1000 ml |
| pH | 6.5 |

The pH was adjusted using aqueous ammonia or hydrochloric acid

| Stabilizing Solution | Tank Solution |
|---|---|
| 1-Hydroxyethylidene-1,1'-diphosphonic acid (60%) | 1.6 ml |
| Bismuth chloride | 0.35 g |
| Polyvinyl pyrrolidone | 0.25 g |
| Aqueous ammonia | 2.5 ml |
| Trisodium nitrilotriacetate | 1.0 g |
| 5-chloro-2-methyl-4-isothiazolin-3-one | 50 mg |
| 2-octyl-4-isothiazolin-3-one | 50 mg |
| Fluorescent brightening agent (4,4'-diaminostilbene type) | 1.0 g |
| Water to make | 1000 ml |
| pH | 7.5 |

The pH was adjusted using potassium hydroxide or hydrochloric acid.

In the present invention, at least two nucleating agents used are preferably selected from those represented by general formulae (N-I) or (N-II).

The nucleating agents employed in the present invention preferably include two kinds of those selected from quaternary heterocyclic compounds (compounds represented by general formula (N-I) below), and hydrazine type compounds (compounds represented by general formula (N-II) below).

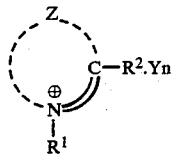

(N-I)

wherein Z represents a non-metallic atomic group necessary for forming a substituted or unsubstituted 5-membered or 6-membered heterocyclic ring; $R^1$ represents a substituted or unsubstituted aliphatic group, $R^2$ represents a hydrogen atom, a substituted or unsubstituted aliphatic group or a substituted or unsubstituted aromatic group; provided that at least one of $R^1$, $R^2$ and Z contains an alkynyl group, an acyl group, a hydrazine group or a hydrazone group, or R1 and R2 together form a 6-membered ring to complete a dihydropyridinium skeleton; Y represents a counter ion necessary for charge balance; and n is 0 or 1; at least one of the substituents of $R^1$, $R^2$ and Z may contain the group $X^1$—$L^1{}_m$, in which $X^1$ represents a group capable of accelerating adsorption by a silver halide grain, $L^1$ represents a divalent linking group and m is 0 or 1.

More particularly, the heterocyclic ring formed by Z includes a quinolinium nucleus, a benzothiazolium nucleus, a benzimidazolium nucleus, a pyridinium nucleus, a thiazolinium nucleus, a thiazolium nucleus, a naphthothiazolium nucleus, a selenazolium nucleus, a benzoselenazolium nucleus, an imidazolium nucleus, a tetrazolium nucleus, an indolenium nucleus, a pyrrolinium nucleus, an acridinium nucleus, a phenanthridinium nucleus, an isoquinolium nucleus, an oxazolium nucleus, a naphthoxazolium nucleus and a benzoxazolium nucleus. The substituents for Z include an alkyl group, an alkenyl group, an aralkyl group, an aryl group, an alkynyl group, a hydroxyl group, an alkoxyl group, an aryloxyl group, a halogen atom, an amino group, an alkylthio group, an acrylthio group, an acyloxyl group, an acylamino group, a sulfonyl group, a sulfonyloxyl group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group and an imino group. Preferably, at least one of the above substituents is present as a substituent for Z, and if there are two or more substituents for Z, they may be the same or different. The above substituents may be further substituted by the substituents mentioned above.

Further, the substituent for Z may have a heterocyclic ring quaternary ammonium group formed by Z via suitable linking group L. In this case, it forms a dimer structure.

The heterocyclic ring completed by Z is preferably a quinolinium nucleus, a benzothiazolium nucleus, a benzimidazolium nucleus, a pyridinium nucleus, an acridinium nucleus, a phenanthridinium nucleus or an isoquinolinium nucleus, with a quinolinium nucleus and a benzothiazolium nucleus being more preferred. Quinolium nucleus are most preferred.

The aliphatic group represented by $R^1$ or $R^2$ is an unsubstituted alkyl group having from 1 to 18 carbon atoms or a substituted alkyl group having from 1 to 18 carbon atoms in the alkyl moiety. The substituents may be the same as those described for Z.

The aromatic group represented by $R^2$ is one having from 6 to 20 carbon atoms, such as a phenyl group and a naphthyl group. The substituents are the same as those defined for Z. Preferably $R^2$ represents an aliphatic group, most preferably a methyl group or a substituted methyl group.

Of the groups represented by $R^1$, $R^2$ and Z, at least one group contains an alkynyl group, an acyl group, a hydrazine group or a hydrazone group, or $R^1$ and $R^2$ are linked to form a 6-membered ring to complete a dihydropyridinium skeleton; and these groups may be substituted with the substituents for Z described above.

It is preferred that at least one of the substituents on the ring or the group represented by $R^1$, $R^2$ and Z is an alkynyl group or an acyl-group, or that $R^1$ and R2 together form a dihydropyridinium skeleton, and it is most preferred that at least one alkynyl group is present.

Preferred examples of the group capable of accelerating adsorption by silver halide represented by $X^1$ include a thioamido group, a mercapto group and a 5-membered or 6-membered nitrogen-containing heterocyclic group. These groups may be substituted with the substituents defined for Z. Preferably the thioamido group is a non-cyclic thioamido group (for example, thiourethane and thioureido).

The mercapto group represented by $X^1$ is particularly preferably a heterocyclic mercapto group (for example, 5-mercaptotetrazole, 3-mercapto-1,2,4-triazole, and 2-mercapto-1,3,4-thiadiazole).

The 5- or 6-membered nitrogen-containing heterocyclic ring represented by $X^1$ contains a combination of nitrogen, oxygen, sulfur and carbon and preferably is one that will form an imino silver, such as benzotriazole.

The divalent linking group represented by $L^1$ is an atomic group containing at least one of C, N, S and O and more specifically contains, for example, one or a combination of an alkylene group, an alkenylene group, an alkynylene group, an arylene group, —O—, —S—, —NH—, —N—, CO—, and —$SO_2$— which may be substituted with a substituent (e.g., alkyl, alkenyl, aryl, alkoxyl, aryloxyl, alkylthio, arylthio, cyano, amido, acyl, sulfonamido, ureido, carbamoyl, sulfamoyl).

The counter ion for charge balance represented by Y includes a bromide ion, a chloride ion, an iodine ion, a p-toluenesulfonate ion, an ethylsulfonate ion, a perchlorate ion, a trifluoromethanesulfonate ion and a thiocyanate ion.

Examples of these compounds and synthetic methods therefor are described, for example in the patents cited in *Research Disclosure*, No. 22534 (January, 1983), pages 50 to 54; ibid., No. 23213 (August, 1983), pages 267 to 270; JP-B-49-38164 (the term "JP-B" as used herein means an "examined Japanese patent publication"); JP-B-52-19452; JP-B-52-47326; JP-A-52-69613; JP-A-52-3426; JP-A-55-138742; JP-A-60-11837; and U.S. Pat. Nos. 4,306,016 and 4,471,044.

Specific examples of the compounds represented by general formula (N-I) are set forth below, but the present invention is not to be construed as being limited to these compounds.

(N-I-1)

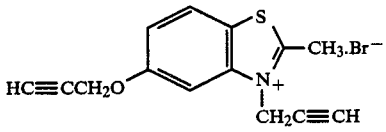

(N-I-2)

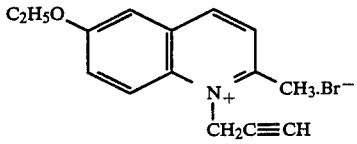

(N-I-3)

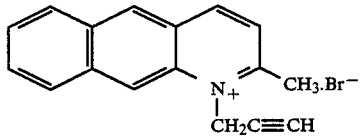

(N-I-4)

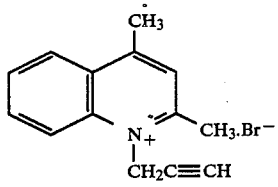

(N-I-5)

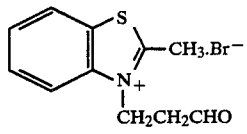

(N-I-6)

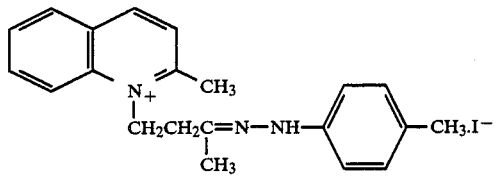

-continued
(N-I-7)
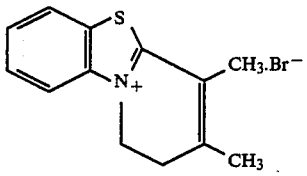
(N-I-8)
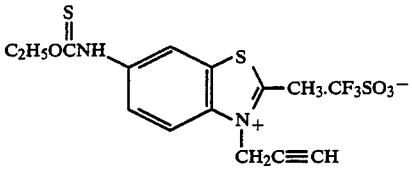
(N-I-9)
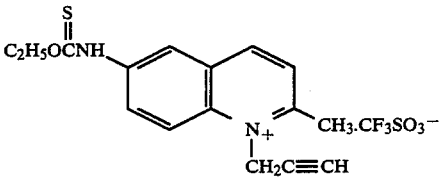
(N-I-10)
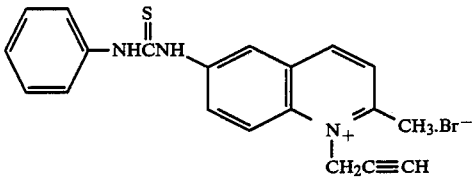
(N-I-11)
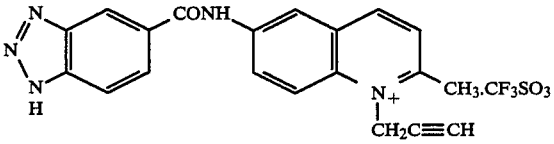
(N-I-12)
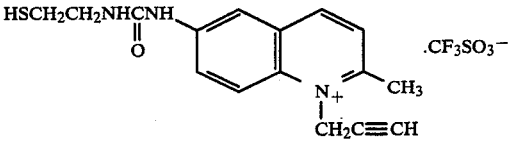
(N-I-13)
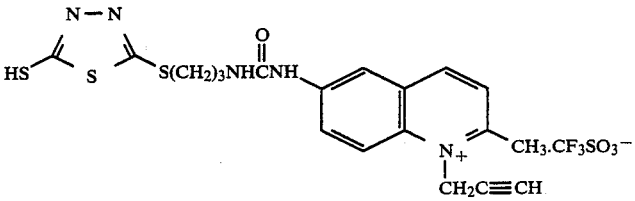
(N-I-14)
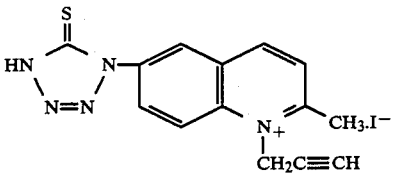
(N-I-15)
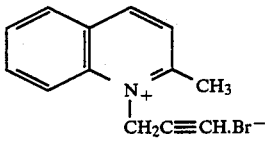

-continued
(N-I-16)
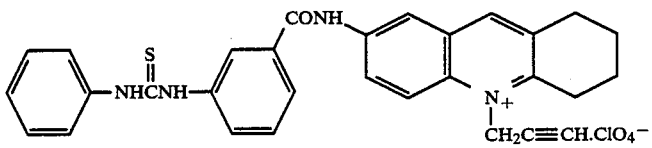
(N-I-17)
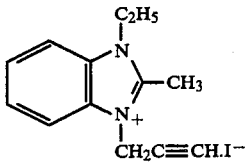
(N-I-18)
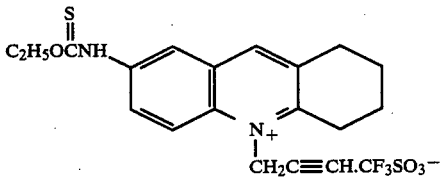
(N-I-19)
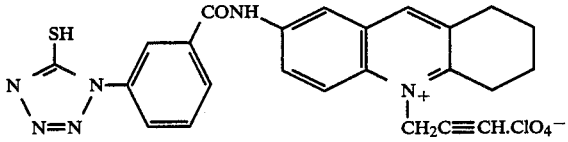
(N-I-20)
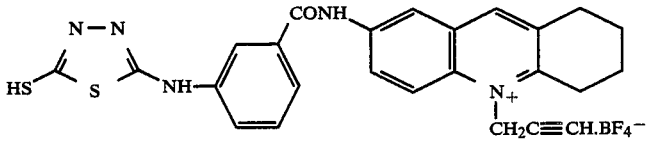
(N-I-21)
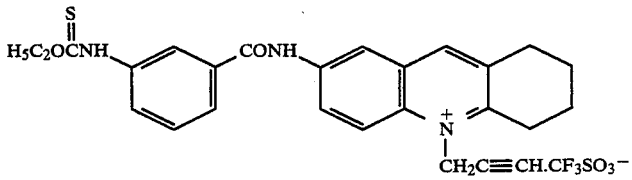
(N-I-22)
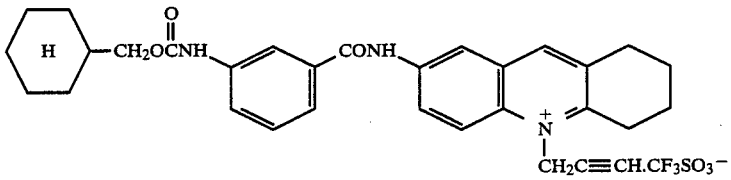
(N-I-23)
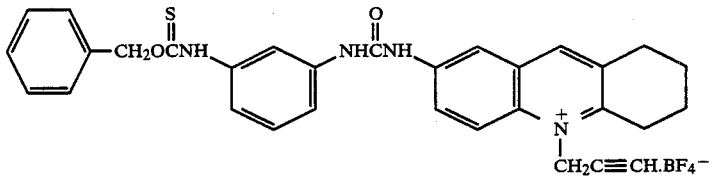
(N-I-24)
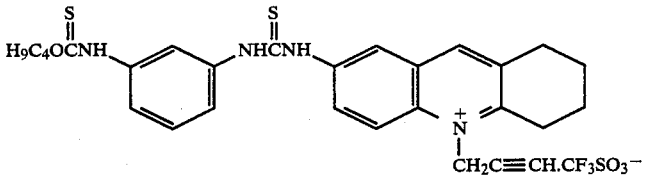

-continued (N-I-25)

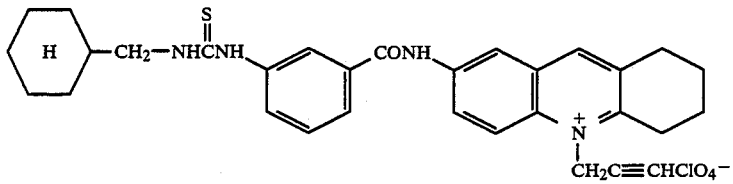

(N-I-26)

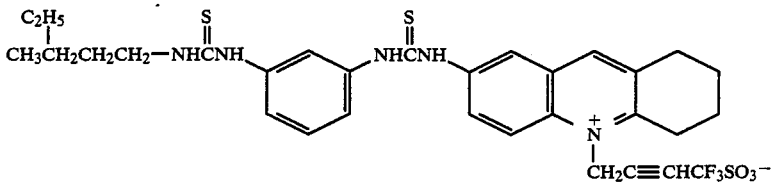

(N-I-27)

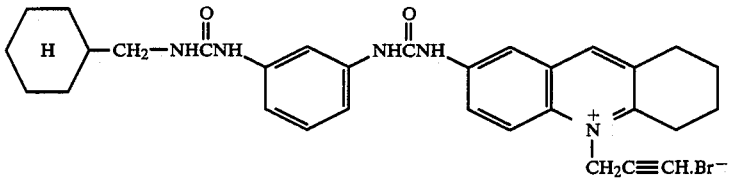

(N-I-28)

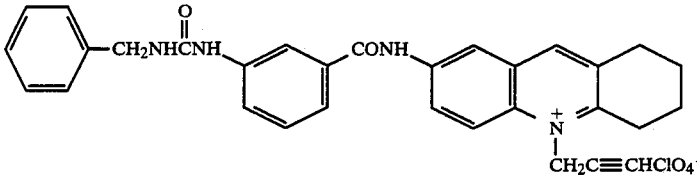

(N-I-29)

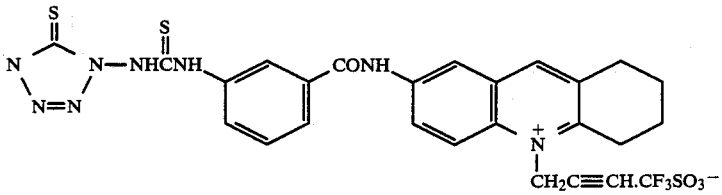

(N-I-30)

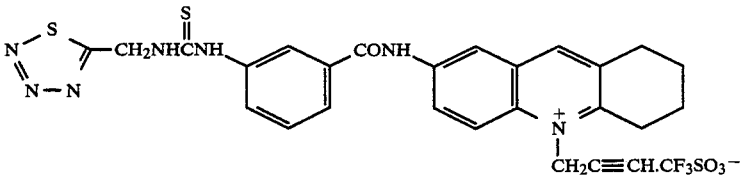

(N-II)

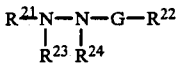

wherein $R^{21}$ represents an aliphatic group, an aromatic group or a heterocyclic group; $R^{22}$ represents a hydrogen atom, an alkyl group, an aralkyl group, an aryl group, an alkoxyl group, an aryloxyl group or an amino group; G represents a carbonyl group, a sulfonyl group, a sulfoxyl group, a phosphoryl group or an iminomethylene group

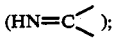

and $R^{23}$ and $R^{24}$ both represent a hydrogen atom, or one of $R^{23}$ and $R^{24}$ represents a hydrogen atom and the other represents an alkylsulfonyl group, an arylsulfonyl group or an acyl group and G, $R^{23}$ and $R^{24}$ together with the hydrazine nitrogens may form a hydrozone structure

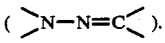

In general formula (N-II) the aliphatic groups represented by $R^{21}$ have preferably 1–30 carbon atoms, more preferably 1–20 carbon atoms and include an alkyl group, an alkenyl group, or an alkynyl group such as a straight chain group (e.g., ethyl, allyl), a branched chain group (e.g., isobutyl, 2-ethylhexyl) and a cyclic group (e.g., cyclohexyl); the aromatic groups represented by $R^{21}$ are the monocyclic or bicyclic aryl groups (e.g., phenyl, naphthyl); and the heterocyclic groups represented by $R^{21}$ are the saturated or unsaturated 3- to 10-membered ones containing at least one of N, O, and S atoms which may be monocyclic group or may form condensed rings with other aromatic rings or heterocyclic rings. Preferred heterocyclic rings are the 5- or 6-membered aromatic heterocyclic rings, (e.g., pyridyl, quinolyl, imidazolyl, benzimidazolyl).

The substituted or unsubstituted alkyl groups represented by $R^{22}$ are the straight chain, branched chain or cyclic alkyl groups having 1 to 20 carbon atoms. The substituted or unsubstituted aralkyl groups represented by $R^{22}$ are those having 1 to 10 carbon atoms in the alkyl moiety and examples of the aryl groups include a phenyl group and a naphthyl group.

The substituted or unsubstituted aryl groups represented by $R^{22}$ are preferably the monocyclic or bicyclic aryl groups having 6 to 20 carbon atoms and those containing a benzene ring and a naphthalene ring.

The substituted or unsubstituted alkoxyl groups represented by $R^{22}$ are preferably those having 1 to 20 carbon atoms.

The substituted or unsubstituted aryloxyl groups represented by $R^{22}$ are preferably the monocyclic ones having 6 to 26 carbon atoms.

The substituted or unsubstituted amino groups represented by $R^{22}$ are preferably those having less than 20 carbon atoms.

These group may, if possible, be substituted with a substituent.

More specifically, the groups represented by $R^{21}$ may be substituted with one or more substituents, which in turn may be further substituted, such as an alkyl group, an aralkyl group, an alkoxyl group, an amino group substituted with an alkyl or aryl group, an acylamino group, a sulfonylamino group, a ureido group, a urethane group, an aryloxyl group, a sulfamoyl group, a carbamoyl group, an aryl group, an alkylthio group, an arylthio group, a sulfonyl group, a sulfinyl group, a hydroxyl group, a halogen atom, a cyano group, a sulfo group and a carboxyl group, with a ureido group particularly preferred, which groups may link together to form a ring if possible.

Preferably, $R^{21}$ represents an aromatic group, an aromatic heterocyclic group or an aryl-substituted methyl group, with an aryl group (for example, phenyl and naphthyl) more preferred.

Preferably, $R^{22}$ represents a hydrogen atom, an alkyl group (for example, methyl) or an aralkyl group (for example, o-phydroxybenzyl), with a hydrogen atom particularly preferred.

The substituents for $R^{22}$ include those defined for $R^{21}$ as well as an acyl group, an acyloxyl group, an alkyloxycarbonyl group, an aryloxycarbonyl group, an alkenyl group, an alkynyl group and a nitro group, which may be further substituted by any of these substituents, and, if possible, may link together to form a ring.

$R^{21}$ or $R^{22}$, in particular $R^{21}$, may contain a so-called ballast group, i.e., a diffusion-resistant group as used in a coupler (preferably linked through a ureido group) and may contain a group $X^2$–$(L^2)_{m2}$ capable of accelerating adsorption onto the surface of silver halide grains, where $X^2$ has the same meaning as defined for $X^1$ in general formula (N-I) above and preferably represents a thioamido group (excluding a thiosemicarbazide and its substitution product), a mercapto group or a 5-membered or 6-membered nitrogen-containing heterocyclic group, $L^2$ represents a divalent linking group and has the same meaning as defined for $L^1$ in general formula (N-I) above, and $m^2$ is 0 or 1.

More preferably, $X^2$ represents an acyclic thio-amido group (for example, thioureido and thiourethane), a acyclic thioamido group (e.g., a mercapto-substituted nitrogen-containing heterocyclic ring such as 2-mercaptothiadiazole, 3-mercapto-1,2,4-triazole, 5-mercaptotetrazole, 2-mercapto-1,3-oxadiazole and 2-mercaptobenzoxazole group) or a nitrogen-containing heterocyclic ring group (for example, benzotriazole, benzimidazole and indazole).

Most preferably, $X^2$ is determined based on the photographic light-sensitive material. For example, in the case of a color photographic light-sensitive material that uses a coloring material (a so-called coupler) that forms a dye upon a coupling reaction with the oxidation product of a p-phenylenediamine type developing agent, $X^2$ preferably represents a mercapto-substituted nitrogen-containing heterocyclic ring or a nitrogen-containing heterocyclic ring that will form an imino silver. Further, in the case of a color photographic light-sensitive material that uses a coloring material (a so-called DRR compound) that forms a diffusion-resistant dye upon cross-oxidation of the oxidation product of a developing agent, $X^2$ preferably represents a acyclic thiamido group or a mercapto-substituted nitrogen-containing heterocyclic ring. Moreover, in the case of a black-and-white photographic light-sensitive material, $X^2$ preferably represents a mercapto-substituted nitrogen-containing heterocyclic ring or a nitrogen-containing heterocyclic ring that will form an imino silver.

Most preferably, $R^{23}$ and $R^{24}$ represent a hydrogen atom.

Most preferably, G in general formula (N-II) represents a carbonyl group.

Further, of the compounds represented by general formula (N-II), those containing a group capable of being adsorbed onto silver halide or a ureido group are more preferred.

Examples of hydrazine type nucleating agents having a group capable of being absorbed onto silver halide, and synthetic methods therefor are described, for example, in U.S. Pat. Nos. 4,030,925, 4,080,207, 4,031,127, 3,718,470, 4,269,929, 4,276,364, 4,278,748, 4,385,108, 4,459,347, 4,478,928 and 4,560,638, British Patent No. 2,011,391B, JP-A-54-74729, JP-A-55-163533, JP-A-55-74536 and JP-A-60-179734.

Examples of other hydrazine type nucleating agents and synthetic methods therefor are described, for example, in JP-A-57-86829, U.S. Pat. Nos. 4,560,638, 4,478,928, 2,563,785 and 2,588,982.

Specific examples of the compounds represented by general formula (N-II) are set forth below, but the present invention is not to be construed as being limited to them.

(N-II-1)

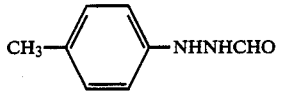

-continued
(N-II-2)
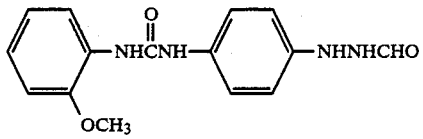
(N-II-3)
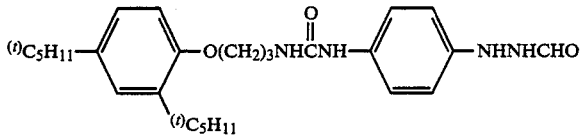
(N-II-4)
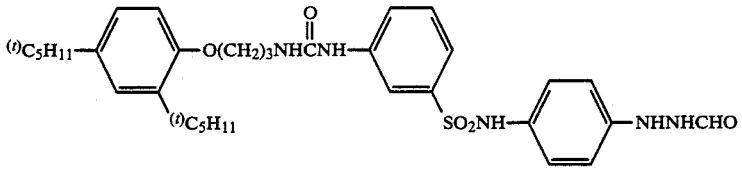
(N-II-5)
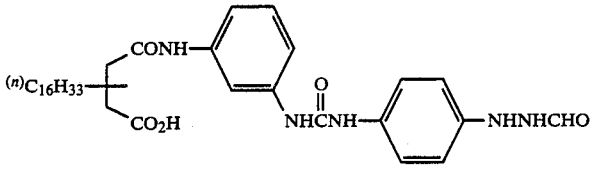
(N-II-6)
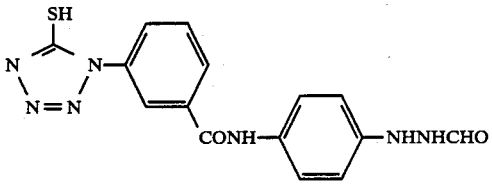
(N-II-7)
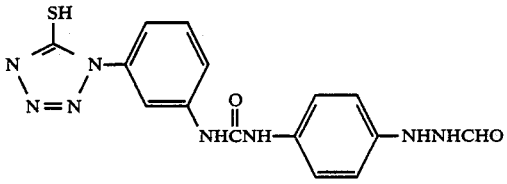
(N-II-8)
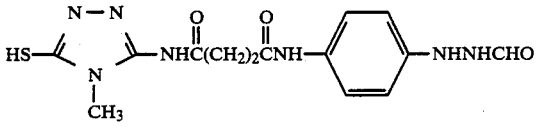
(N-II-9)
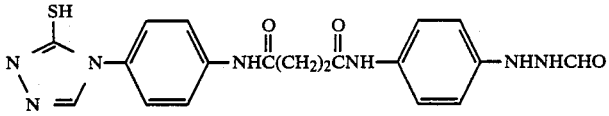
(N-II-10)
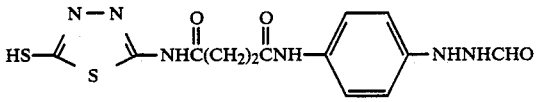
(N-II-11)
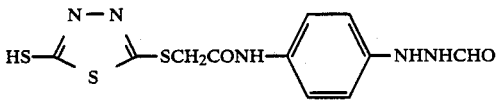

-continued
(N-II-12)
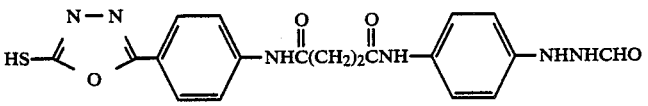
(N-II-13)
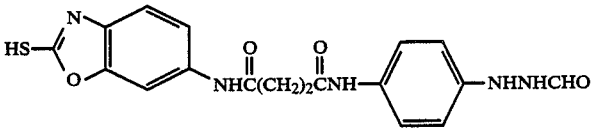
(N-II-14)
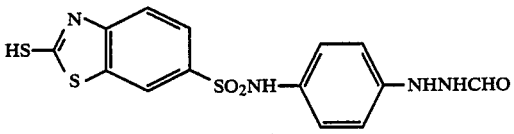
(N-II-15)
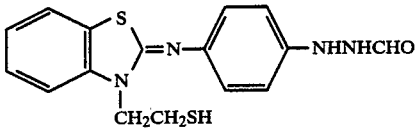
(N-II-16)
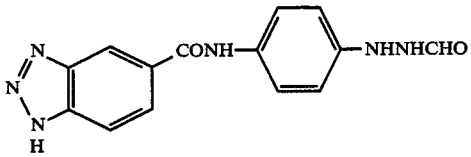
(N-II-17)
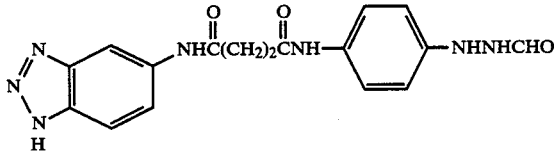
(N-II-18)
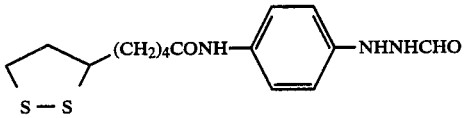
(N-II-19)
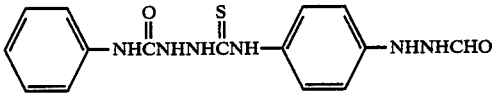
(N-II-20)
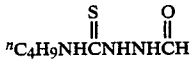
(N-II-21)
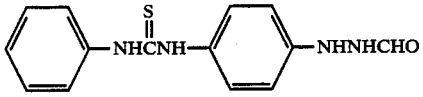
(N-II-22)
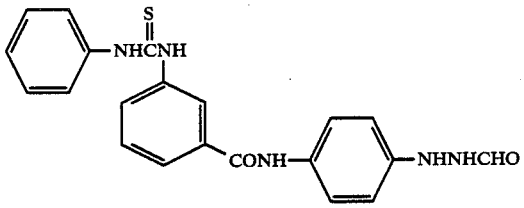

-continued (N-II-23)

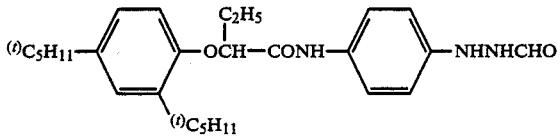

(N-II-24)

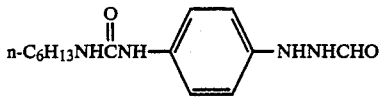

(N-II-25)

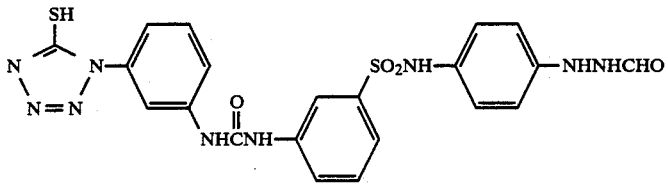

(N-II-26)

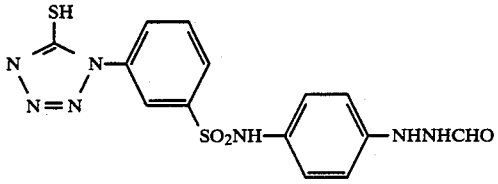

(N-II-27)

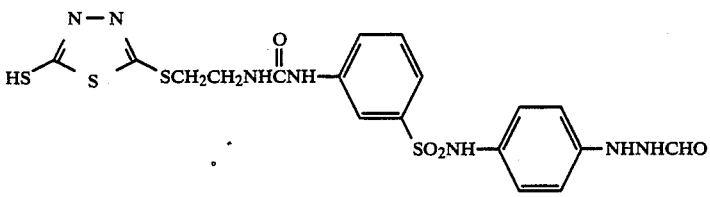

(N-II-28)

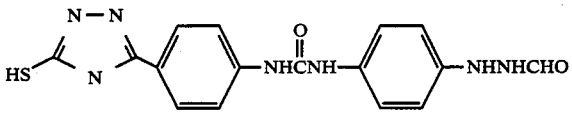

(N-II-29)

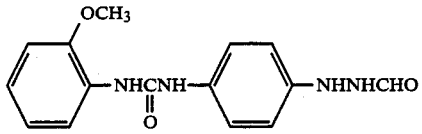

(N-II-30)

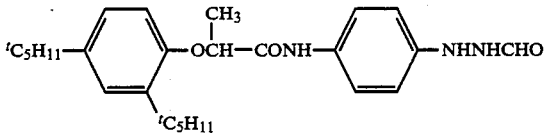

The nucleating agents used in the present invention can be incorporated into the photographic light-sensitive material or into a processing solution for the photographic light-sensitive material, and preferably is incorporated into the photographic light-sensitive material.

When the nucleating agents used in the present invention are incorporated into the photographic light-sensitive material, although it is preferred that they are added to an internal latent image type silver halide emulsion layer, they can be added to other layers such as an intermediate layer, a subbing layer or a backing layer so long as the nucleating agents diffuse during application or processing to be adsorbed onto the silver halide. When the nucleating agents are added to a processing solution, they can be added to a developing solution or a prior bath having a low pH as described in JP-A-58-178350.

When the nucleating agent are incorporated into the photographic light-sensitive material, preferably the amount thereof is about $10^{-8}$ to about $10^{-2}$ mol, more preferably about $10^{-7}$ to about $10^{-3}$, per mol of silver halide contained in an emulsion layer.

When the nucleating agents are added to the processing solution, preferably the amount of the nucleating agents is about $10^{-5}$ to about $10^{-1}$ mol, more preferably about $10^{-4}$ to about $10^{-2}$ mol, per liter thereof.

The nucleating rate used in the present invention is a relative value as described above and it is not helpful that the nucleating agents be classified into those of high activity and those of low activity.

Examples of the combinations of nucleating agents preferably employed in the present invention and the ratio of nucleating rates thereof are set forth below.

| | High-Active Nucleating Agent | Low-Active Nucleating Agent | Ratio of Nucleating Rates |
|---|---|---|---|
| 1 | [N-I-9] | [N-I-15] | 2.1 |
| 2 | [N-I-16] | [N-I-17] | 8.0 |
| 3 | [N-I-18] | [N-II-6] | 213 |
| 4 | [N-I-19] | [N-II-6] | 320 |
| 5 | [N-I-19] | [N-II-7] | 42 |
| 6 | [N-I-20] | [N-II-7] | 80 |
| 7 | [N-II-25] | [N-II-6] | 7.0 |
| 8 | [N-II-26] | [N-II-16] | 8.1 |
| 9 | [N-II-27] | [N-II-16] | 4.5 |
| 10 | [N-II-28] | [N-II-21] | 11 |
| 11 | [N-II-27] | [N-II-21] | 15 |
| 12 | [N-II-28] | [N-II-29] | 16 |
| 13 | [N-II-7] | [N-II-30] | 85 |
| 14 | [N-I-20] | [N-II- 6] | 610 |

The internal latent image type silver halide emulsion not having been previously fogged which can be used in the present invention includes an emulsion containing silver halide grains whose surfaces have not been previously fogged, and which form latent images predominantly in the interior of grains. More specifically, suitable emulsions have the characteristic that when coated on a transparent support in a predetermined amount ranging from 0.5 g/m$^2$ to 3 g/m$^2$ in terms of silver, exposed for a fixed time between 0.01 and 10 seconds, then developed at 18° C. for 5 minutes in the following developing solution A (internal developer), provide a maximum density (measured by a conventional photographic density measuring method) of at least about 5 times, more preferably at least about 10 times, as much as that obtained by coating and exposing the emulsion in the same manner as described above, but developing at 20° C. for 6 minutes in the following developing solution B (surface developer):

| | |
|---|---|
| Internal developer A | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| Surface developer B | |
| Metol | 2.5 g |
| l-Ascorbic acid | 10 g |
| $NaBO_2.4H_2O$ | 35 g |
| KBr | 1 g |
| Water to make | 1 liter |

Specific examples of the internal latent image type emulsions include conversion type silver halide emulsions as described for example, in U.S. Pat. No. 2,592,250, and core/shell type silver halide emulsions as described, for example, in U.S. Pat. Nos. 3,761,276, 3,850,637, 3,923,513, 4,035,187, 4,395,478 and 4,504,570, JP-A-52-156614, JP-A-55-127549, JP-A-53-60222, JP-A-56-22681, JP-A-59-208540, JP-A-60-107641, JP-A-61-3137, and JP-A-62-215272, and the patents cited in *Research Disclosure,* No. 23510 (November, 1983) page 236.

Although the internal latent image type silver halide grains used in the present invention may be conversion type emulsions or core/shell type emulsions, those having a core/shell stratified form are preferred from the standpoint of easy control of photographic sensitivity, gradation, etc. The core and shell are preferably composed of silver bromide, silver iodobromide, silver chlorobromide or silver chloroiodo-bromide containing silver bromide and not more than 10 mol%, preferably not more than 3 mol% of silver iodide. The core may be a so-called conversion type or a conventional grain. The halogen composition of core and shell may be the same or different. Suitable examples of silver halide emulsions having a core/shell structure which can be used are described, for example, in JP-A-55-127549, U.S. Pat. No. 4,395,478 and West German Patent No. 2,332,802 C2.

The average grain size (the grain size being defined as the diameter of the grains when the grain has a spherical or a nearly spherical form and as the length of the edge when the grain has a cubic form, and being averaged based on projected area of the grains) of the silver halide grains is preferably from 0.1 μm up to 1.5 μm, and particularly preferably from 0.2 μm to 1.2 μm. Although the distribution of the grain size may be either broad or narrow, in order to improve graininess, sharpness, etc., it is preferred in the present invention to use a so-called "monodispersed" silver halide emulsion having narrow grain size distribution such that 90% or more, particularly 95% or more of all the grains fall within ±40%, more preferably ±30% and most preferably ±20%, of the average grain size, in terms of grain number or weight.

In order to satisfy the gradation required for the photographic light-sensitive material, in emulsion layers having substantially the same color sensitivity, two or more monodispersed silver halide emulsions different in grain size or a plurality of grains of the same size but different in sensitivity are mixed in the same layer or are applied as different layers that are superposed. Two or more polydispersed silver halide emulsions or a monodispersed silver halide emulsion and a polydispersed silver halide emulsion can be used in the form of a mixture or in superposed layers.

The silver halide grains used in the present invention may be regular crystals such as cubic, octahedral, dodecahedral or tetradecahedral crystals or irregular crystals such as spherical crystals, or may have a composite form of these crystal forms. Further, tabular silver halide grains having a diameter/thickness ratio of at least 5, particularly at least 8, accounting for at least 50% of the total projected area of the silver halide grains may be used. Moreover, an emulsion composed of a mixture of these various crystals may be employed.

In the silver halide emulsion used in the present invention, the interior or the surface of the grains may be chemically sensitized by sulfur sensitization, selenium sensitization, reduction sensitization or noble metal sensitization, that can be used alone or in combination. Specific examples of useful chemical sensitization methods are described, for example, in the patents cited in *Research Disclosure,* No. 17643-III (December, 1978), page 23.

The photographic emulsion used in the present invention is spectrally sensitized with a photographic sensitizing dye in a conventional manner. Particularly useful dyes are cyanine dyes, merocyanine dyes and complex merocyanine dyes, which may be used alone or in combination, and also can be used in combination with supersensitizers. Specific examples thereof are described, for example, in the patents cited in *Research Disclosure,* No. 17643-IV (December, 1978), pages 23 to 24.

The photographic emulsions used in the present invention can contain an antifoggant or a stabilizer for the purpose of stabilizing the photographic performance, or of preventing formation of fog during the production, storage or photographic processing of the photographic light-sensitive material. Specific examples of antifoggants and stabilizers are described, for example, in *Research disclosure,* No. 17643-VI (December, 1978}, and E. J. Birr, *Stabilization of Photographic Silver Halide Emulsions,* 1974 (Focal Press), etc.

In order to form direct positive color images, various color couplers can be employed. Useful color couplers are compounds that can undergo a coupling reaction with an oxidation product of an aromatic primary amine type color developing agent to produce or release a dye substantially non-diffusible and that themselves are preferably substantially non-diffusible. Typical examples of useful color couplers include naphtholic or phenolic compounds, pyrazolone or pyrazoloazole compounds and open chain or heterocyclic ketomethylene compounds. Specific examples of these cyan, magenta and yellow couplers which can be used in the present invention are compounds as described in *Research Disclosure,* No. 17643 (December, 1978), page 25, section VII-D; ibid., No. 18717 (November, 1979); JP-A-62-215272; and compounds described in the patents cited therein.

Among others, typical yellow couplers that can be used in the present invention include yellow two-equivalent couplers of oxygen atom releasing or nitrogen atom releasing type. Particularly, α-pivaloylacetanilide type couplers are excellent in fastness, in particular light-fastness, of the dyes formed therefrom, while α-benzoylacetanilide type couplers are preferred because a high color density can be obtained.

5-Pyrazolone type magenta couplers preferably used in the present invention are 5-pyrazolone type couplers (particularly, sulfur atom releasing type two-equivalent couplers) substituted at the 3-position with an arylamino group or an acylamino group.

Pyrazoloazole type couplers are further preferred. Among them, pyrazolo[5-1-c][1,2,4]triazoles described in U.S. Pat. No. 3,725,067 are preferred, imidazo[1,2-b]-pyrazoles described in U.S. Pat. No. 4,500,630 are more preferred in view of the fastness to light and the low yellow subsidiary absorption of the dye formed therefrom, and pyrazolo[1,5-b][1,2,4]triazoles described in U.S. Pat. No. 4,540,654 are most preferred.

Cyan couplers preferably used in the present invention include naphtholic and phenolic couplers described in U.S. Pat. Nos. 2,474,293 and 4,052,212 and phenolic cyan couplers having an alkyl group containing two or more carbon atoms at the m-position of the phenol nucleus described in U.S. Pat. No. 3,772,002. In addition, 2,5-diacylamino-substituted phenolic couplers are also preferred in view of fastness of color image formed therefrom.

Colored couplers for correcting undesired absorption in the short wavelength range of dyes produced; couplers capable of forming dyes with appropriate diffusibility; non-color forming couplers; DIR couplers that can release a development inhibitor as a result of the coupling reaction; and polymerized couplers can also be used.

Generally, the amount of color coupler used is in the range of about 0.001 to 1 mol per mol of a light-sensitive silver halide, and preferably in the case of a yellow coupler the amount is about 0.01 to 0.5 mol per mol of a light-sensitive silver halide, in the case of a magenta coupler the amount is about 0.002 to 0.5 mol per mol of a light-sensitive silver halide.

In the present invention, a color formation reinforcing agent can be employed for the purpose of increasing the color forming property of couplers. Representative examples of such compounds are described in JP-A-62-215272.

The couplers used in the present invention are dissolved in an organic solvent having a high boiling point and/or an organic solvent having a low boiling point, the solution is finely emulsified or dispersed in an aqueous solution of gelatin or other hydrophilic colloids by means of high speed agitation using a homogenizer, etc., a mechanical procedure using a colloid mill, etc. or a technique using ultrasonic waves and then the emulsified dispersion is mixed with a photographic emulsion, followed by coating to form a layer. In this case, although it is not always necessary to employ an organic solvent having a high boiling point, it is preferred to use such an organic solvent having a high boiling point specific examples of which include the compounds described in JP-A-62-215272.

The couplers used in the present invention can be dispersed in a hydrophilic colloid according to the methods as described in JP-A-62-215272.

The photographic light-sensitive material in accordance with the present invention may contain, as a color fog preventing agent or color mixing preventing agent, hydroquinone derivatives, aminophenol derivatives, aminogallic acid derivatives, catechol derivatives, ascorbic acid derivatives, colorless compound forming couplers, sulfonamidophenol derivatives, etc. Typical examples of color fog preventing agents and color mixing preventing agents are described in JP-A-62-515272.

In the photographic light-sensitive material of the present invention, various color fading preventing agents can be used. Typical organic color fading preventing agents include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives obtained by the silylation or alkylation of the phenolic hydroxyl group of these compounds. Further, metal complexes such as bissalicylaldoxymatonickel complex and bis(N,N-dialkyldithiocarbamato)nickel complexes can be used.

For the purpose of preventing yellow dye images from being deteriorated by heat, humidity and light, compounds having both a hindered amine and a hindered phenol in a single molecule described in U.S. Pat. No. 4,268,593, give good results. For the purpose of preventing magenta dye images from being deteriorated, particularly by heat, spiroindanes described in JP-A-56-159644 and chromans substituted with hydroquinone diethers or monoethers described in JP-A-55-89835 give good results.

Typical examples of these color fading preventing agents are described in JP-A-62-215272. The desired aim can be attained when these compounds are added to light-sensitive layers generally in amounts of 5 to 100 wt % based on the respective color couplers by coemulsifying them with the couplers.

For the purpose of preventing cyan dye images from being deteriorated by heat and, particularly, light, it is effective to introduce an ultraviolet absorber into both layers adjacent to a cyan color forming layer. An ultraviolet absorber can also be added to a hydrophilic colloid layer such as protective layer. Typical examples of such compounds are described in JP-A-62-215272.

As binders or protective colloids which can be used in emulsion layers and intermediate layers of the photographic light-sensitive material of the present invention, it is advantageous to use gelatin, but other hydrophilic colloids than gelatin can also be used.

The photographic light-sensitive material of the present invention can contain dyes for preventing irradiation or halation, ultraviolet absorbers, plasticizers, fluorescent brightening agents, matting agents, aerial fog preventing agents, coating aids, hardening agents, antistatic agents, lubricants, etc. Typical examples of these additives are described in *Research Disclosure,* No. 17643, sections VIII to XIII (December, 1978), pages 25 to 27, and ibid., No. 18716 (November, 1979), pages 647 to 651.

The present invention can be applied to multilayer multicolor photographic materials having at least two layers having different spectral sensitivities on a support. Generally a multilayer natural color photographic material has at least on red-sensitive emulsion layer, at least one green-sensitive emulsion layer and at least one blue-sensitive emulsion layer on a support. The order of these layers is appropriately selected as desired. In a preferred order of the layers, a red-sensitive emulsion layer, a green-sensitive emulsion layer and a blue-sensitive emulsion layer are coated in that order on a support or a green sensitive emulsion layer, a red-sensitive emulsion layer and a blue-sensitive emulsion layer are coated in that order on a support. Each of these emulsion layers may consist of two or more emulsion layers different in sensitivity, or may consist of two or more emulsion layers having the same sensitivity with a light-insensitive layer between them. Generally, the red-sensitive emulsion layer contains a cyan forming coupler, the green-sensitive emulsion layer contains a magenta forming coupler and the blue-sensitive emulsion layer contains a yellow forming coupler, but in some cases the combination can be changed.

It is preferable that the photographic light-sensitive material according to the invention is provided with suitable auxiliary layers such as a protective layer, an intermediate layer, a filter layer, an antihalation layer, a backing layer and a white-light reflective layer, in addition to the silver halide emulsion layers.

In the photographic light-sensitive materials of the present invention, the photographic emulsion layers and other layers are applied on supports as described in *Research Disclosure,* No. 17643, section XVII (December, 1978), page 28, European Patent No. 0,182,253, and JP-A-61-97655. The coating methods described in *Research Disclosure,* No. 17643, section XV, pages 28 to 29 can be employed.

For the purpose of increasing maximum image density of reducing minimum image density, of quickening the development, and of improving preservability of the photographic light-sensitive material, the following compounds can be added: hydroquinones (e.g., compounds described in U.S. Pat. Nos. 3,227,552 and 4,279,987); chromans (e.g., compounds described in U.S. Pat. No. 4,268,621, JP-A-54-103031 and *Research Disclosure,* No. 18264 (June, 1979), pages 333 to 334); quinones (e.g., compounds described in *Research Disclosure,* No. 21206 (December, 1981), pages 433 to 434); amines (e.g., compounds described in U.S. Pat. No. 4,150,993 and JP-A-58-174757; oxidizing agents (e.g., compounds described in JP-A-60-260039 and *Research Disclosure,* No. 16936 (May, 1978), pages 10 to 11); catechols (e.g., compounds described in JP-A-55-21013 and JP-A-55-65944, compounds capable of releasing a nucleating agent at the time of development (e.g., compounds described in JP-A-60-107029, thioureas (e.g., compounds described in JP-A-60-95533; and spirobisindanes (e.g., compounds described in JP-A-55-65944.

When using the photographic light-sensitive material of the present invention for a color diffusion transfer process, coloring materials which themselves are non-diffusible (immobile) in an alkaline solution (developing solution ) but, as a result of development, release a diffusible dye (or its precursor) are advantageously used, while dye developers may be employed as coloring materials. Suitable diffusible dye-releasing type coloring materials (DRR compounds) include couplers and redox compounds capable of releasing a diffusible dye. These compounds are useful not only for photographic materials of color diffusion transfer processes (set processes), but also for photographic materials of thermal developing processes (dry processes) as described, for example, in JP-A-58-58543.

The diffusible dye-releasing redox compounds (hereinafter referred to as "DRR compounds") can be represented by the following general formula:

(Ballast) - (Redox-cleavable atomic group) - D

In the above formula, Ballast and Redox-cleavable atomic group may be those compounds which are described in JP-A-58-163938, pages 12 to 22. D represents a dye (or its precursor) moiety. This dye or dye precursor moiety may be bound to the Redox-cleavable atomic group through a linking group. As the dye moiety represented by D, those which are described in the following literature references are effective:

Examples of yellow dyes:

Those which are described in U.S. Pat. Nos. 3,597,200, 3,309,199, 4,013,633, 4,245,028, 4,156,609, 4,139,383, 4,195,992, 4,148,641, 4,148,643 and 4,366,322, JP-A-51-114930, JP-A-56-71072, Research Disclosure No. 17630 (1978) and ibid., No. 16475 (1977), etc.

Examples of magenta dyes:

Those which are described in U.S. Pat. Nos. 3,435,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of cyan dyes:

Those which are described in U.S. Pat. Nos. 3,482,972, 3,929,760, 4,013,635, 4,268,625, 4,171,220, 4,242,435, 4,142,891, 4,195,994, 4,147,544 and 4,148,642, British Patent No. 1,551,138, JP-A-54-99431, JP-A-52-8827, JP-A-53-47823, JP-A-53-143323, JP-A-54-99431, JP-A-56-71061, European Patents Nos. 53,037 and 53,040, *Research Disclosure,* No. 17630 (1978) and ibid., No. 16475 (1977).

These compounds are ordinarily coated in amounts of from about $1\times10^{-4}$ to about $1\times10^{-2}$ mol/m$^2$, preferably from about $2\times10^{-4}$ to about $2\times10^{-2}$ mol/m$^2$.

In the present invention, these coloring materials may be incorporated into the silver halide emulsion layer associated with them, or in an adjacent layer to the emulsion layer on the exposure side or on the opposite side.

In the case of using the photographic light-sensitive material of the present invention for a color diffusion transfer process, the photographic emulsions may be coated on the same support as image-receiving layers, or may be coated on different supports. The silver halide photographic emulsion layers (light-sensitive element) and the image-receiving layers (image-receiving element) may be provided in a combined form as a film unit, or may be provided as separate and independent photographic materials. As the form of such a film unit, those which are kept together throughout the steps of exposure, development, transfer, and viewing the diffused image obtained or those which are peeled apart after development may be employed, with the latter type being more effective in accordance with the present invention.

Further, the present invention may be applied to various types of color photographic light-sensitive materials.

For instance, color reversal films for slides and television, color reversal papers, instant color films, etc. are typical examples. In addition, the present invention may be applied to color hard copies for preserving images of full color copiers or CRT. The present invention is also applicable to black-and-white photographic light-sensitive materials utilizing mixing of three color couplers, as described in *Research Disclosure,* No. 17123 (July, 1978), etc.

Furthermore, the present invention can be applied to black-and-white photographic light-sensitive materials. Examples of the black-and-white (B/W) photographic light-sensitive materials to which can be applied the present invention include B/W direct positive photographic light-sensitive materials (for example, photographic materials for X-ray, for duplication, for micrography, for photocomposing, and for printing, etc.) described, for example, in JP-A-59-208540 and JP-A-60-260039.

The photographic light-sensitive material of the present invention can form direct positive color images by exposing it to light imagewise, then by subjecting to development with a surface developer containing an aromatic primary amine color developing agent after or during a fogging treatment by means of light or a nucleating agent, followed by bleach processing and fix processing.

The pH of the color developing solution used in the present invention is not particularly restrictive. The photographic light-sensitive material of the present invention is particularly advantageous in that excellent direct positive color images are obtained even when a color developing solution of low pH, particularly a pH of not more than 11.5 is used.

Nucleation accelerating agents which can be used in order to quicken nucleation in the present invention include tetraazaindenes, triazaindenes and pentaazaindenes having at least one mercapto group that may be optionally substituted with an alkali metal atom or an ammonium group, and compounds described in JP-A-63-106656.

Specific examples of the nucleation accelerating agents used are illustrated below, but the present invention is not to be construed as being limited to those compounds.

(A-1): 3-mercapto-1,2,4-triazolo[4,5-a]pyridine
(A-2): 2-mercapto-1,2,4-triazolo[4,5-a]pyrimidine
(A-3): 5-mercapto-1,2,4-triazolo[1,5-a]pyrimidine
(A-4): 7-(2-dimethylaminoethyl)-5-mercapto-1,2,4-triazolo[1,5-a]pyrimidine
(A-5): 3-mercapto-7-methyl-1,2,4-triazolo[4,5-a]pyrimidine
(A-6): 3,6-dimercapto-1,2,4-triazolo[4,5-b]pyridadine
(A-7): 2-mercapto-5-methylthio-1,3,4-thiadiazole
(A-8): 3-mercapto-4-methyl-1,2,4-triazole
(A-9): 2-(3-dimethylaminopropylthio)-5-mercapto-1,3,4-thiadiazole hydrochloride
(A-10): 2-(2-morpholinoethylthio)-5-mercapto-1,3,4-thiadiazole hydrochloride
(A-11): 2-mercapto-5-methylthiomethylthio-1,3,4-thiadiazole sodium salt
(A-12): 4-(2-morpholinoethyl)-3-mercapto-1,2,4-triazole
(A-13): 2-[2-(2-dimethylaminoethylthio)ethylthio]-5-mercapto-1,3,4-thiadiazole hydrochloride
(A-14): 2-(6-dimethylaminohexylthio)-5-merapto-1,3,4-thiadiazole hydrochloride
(A-15): 2-{3-[2-methyl-1-(1,4,5,6-tetrahydropyrimidinyl)]propylthio}-5-mercapto-1,3,4-thiadiazole hydrochloride Although the nucleation accelerating agent can be incorporated into the photographic light-sensitive material or a processing solution, it is preferred to incorporate the nucleation accelerating agent into the photographic light-sensitive material, particularly into an internal latent image type silver halide emulsion layer or other hydrophilic colloid layers such as an intermediate layer, a protective layer, etc.

It is preferred that the nucleation accelerating agent is added to a silver halide emulsion or a layer adjacent thereto.

The amount of the nucleation accelerating agent added to the photographic material is preferably from about $10^{-6}$ to about $10^{-2}$ mol, more preferably from about $10^{-5}$ to about $10^{-2}$ mol, per mol of a silver halide in the layer or adjacent layer.

If the nucleation accelerating agent is added to a processing solution, i.e., a developing solution or a bath prior to the developing solution, the amount of the nucleation accelerating agent is from about $10^{-8}$ to about $10^{-3}$ mol, preferably from about $10^{-7}$ to about $10^{-4}$ mol, per liter of the processing solution.

Two or more nucleation accelerating agents can be used in combination.

A color developing solution which can be used in development processing of the color photographic light-sensitive material according to the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride, p-toluene-sulfonate thereof, etc.

Two or more kinds of color developing agents may be employed in combination, depending on the purpose.

The color developing solution can ordinarily contain pH buffering agents, such as carbonates, borates or phosphates of alkali metals, etc.; and development inhibitors or anti-fogging agents such as bromides, iodides, benzimidazoles, benzothiazoles, or mercapto compounds, etc. Further, if necessary, the color developing solution may contain various preservatives such as, hydroxylamine, diethylhydroxylamine, sulfites, hydrazines, phenylsemicarbazides, triethanolamine, catechol sulfonic acids, triethylenediamine(1,4-diazabicyclo[2,2,2]octane), etc.; organic solvents such as ethylene glycol, diethylene glycol, etc.; development accelerators such as benzyl alcohol, polyethylene glycol, quarternay ammonium salts, amines, etc.; dye forming couplers; competing couplers; fogging agents such as sodium borohydride, etc.; auxiliary developing agents such as 1-phenyl-3-pyrazolidone, etc.; viscosity imparting agents; and various chelating agents represented by aminopolycarboxylic acids, aminopolyphosphonic acids, alkylphosphonic acids, phosphonocarboxylic acids, etc. Representative examples of the chelating agents include ethylenediaminetetraacetic acid, nitrilotriacetic acid, diethylenetriaminepentaacetic acid, cyclohexanediamine-tetraacetic acid, hydroxyethyliminodiacetic acid, 1-hydroxyethlidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

The pH of the color developing solution used is ordinarily not more than 11.5, preferably in the range from 9.5 to 11.2. Further, the amount of replenishment for the developing solution can be varied depending on color photographic light-sensitive materials to be processed, but is generally not more than 1 liter per square meter of the photographic light-sensitive material. The amount of replenishment can be reduced to not more than 300 ml by decreasing the bromide ion concentration in the replenisher. In the case of reducing the amount of replenishment, it is preferred to prevent evaporation and aerial oxidation of the processing solution by means of reducing the area of the processing tank which is in contact with air. Further, the amount of replenishment can be reduced using a means which restrains accumulation of bromide ion in the developing solution.

After color development, the photographic emulsion layers are usually subjected to a bleach processing. The bleach processing can be performed simultaneously with a fix processing (bleach-fix processing), or it can be performed independently from the fix processing. Further, for the purpose of performing a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a polyvalent metal such as iron (III), cobalt (III), chromium (VI), copper (II); peracids; quinones; nitro compounds. Representative examples of the bleaching agents include ferricyanides; dichloromates; organic complex salts of iron(III) or cobalt(III), for example, complex salts of aminopolycarboxylic acids (such as ethylenediamine-tetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid), or complex salts of organic acids (such as citric acid, tartaric acid, malic acid); persulfates; bromates; permanganates; nitrobenzenes. Of these compounds, iron (III) complex salts of aminopolycarboxylic acids represented by iron (III) complex salts of ethylenediaminetetraacetic acid and persulfates are preferred in view of rapid processing and less environmental pollution. Furthermore, iron (III) complex salts of aminopolycarboxylic acids are particularly useful in both bleaching solutions and bleach-fixing solutions.

The pH of the bleaching solution or bleach-fixing solution containing an iron (III) complex salt of aminopolycarboxylic acid is usually in the range of from 5.5 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond described in U.S. Pat. No. 3,893,858, West German Patent No. 1,290,812, JP-A-53-95630, and *Research Disclosure*, No. 17129 (July 1978); thiazolidine derivatives described in JP-A-50-140129; thiourea derivatives described in U.S. Pat. No. 3,706,561; iodides described in JP-A-58-16235; polyoxyethylene compounds described in West German Patent No. 2,748,430; polyamine compounds described in JP-B-45-8836; and bromide ions. Of these compounds, the compounds having a mercapto group or a disulfide bond are preferred in view of their large bleach accelerating effects. Particularly, the compounds described in U.S. Pat. No. 3,893,858, West German Patent No. 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

As fixing agents which can be employed in the fixing solution or bleach-fixing solution, thiosulfates, thiocyanate, thioether compounds, thioureas, a large amount of iodide, etc. are exemplified. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on the characteristics of photographic light-sensitive materials (due to elements used therein, for example, couplers) uses thereof, temperature of washing water, the number of water washing tanks (stages), a replenishment system such as countercurrent or cocurrent, or other various conditions. The relationship between the number of water washing tanks and the amount of water in a multistage countercurrent system can be determined based on the method described in *Journal of the Society of*

*Motion Picture and Television Engineers*, Vol. 64, pages 248 to 253 (May, 1955).

According to the multistage countercurrent system described in the above literature, the amount of water for washing can be significantly reduced. However, an increase in staying time of water in a tank causes propagation of bacteria and some problems such as adhesion of floatage formed on the photographic materials occur. In the method of processing the silver halide color photographic material according to the present invention, a method for reducing amounts of calcium ions and magnesium ions described in Japanese Patent Application No. 61-131632 can be particularly effectively employed in order to solve such problems. Further, sterilizers, for example, isothiazolone compounds described in JP-A-57-8542, thiabenzazoles, chlorine type sterilizers such as sodium chloroisocyanurate, etc., benzotriazoles, sterilizers described in Hiroshi Horiguchi, *Bokin-Bobai No Kagaku*, (1982) *Biseibutsu No Mekkin-, Sakkin-, Bobai-Gijutsu* (1982), edited by Eiseigijutsu Kai, *Bokin-Bobaizai Jiten* (1985), edited by Nippon Bokin-Bobai Gakkai, etc. can be employed.

The pH of the washing water used in the processing of the photographic light-sensitive materials according to the present invention is usually from 4 to 9, preferably from 5 to 8. The temperature of the washing water and the time for the water washing step can be variously set depending on characteristics or uses of photographic light-sensitive materials, etc. However, it is general to select the range of from 15° C. to 45° C. and a period of from 20 sec. to 10 min. and preferably the range of from 25° C to 40° C. and a period of from 30 sec. to 5 min.

The photographic light-sensitive material according to the present invention can also be directly processed with a stabilizing solution in place of the above-described water washing step. In such a stabilizing process, any of known methods described in JP-A-57-8543, JP-A-58-14834 and JP-A-60-220345 can be employed. To such a stabilizing bath, various chelating agents and antimolds may also be added.

Overflow solutions resulting from replenishment of the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds described in U.S. Pat. Nos. 3,342,597, Schiff's base type compounds described in U.S. Pat. No. 3,342,599, *Research Disclosure*, No. 14850 and ibid., No. 15159, aldol compounds as described in *Research Disclosure*, No. 13924, metal salt complexes described in U.S. Pat. No. 3,719,492, urethane type compounds described in JP-A-53-135628, etc.

Further, the silver halide color photographic material according to the present invention may contain, if desired, various 1-phenyl-3-pyrazolidones for the purpose of accelerating color development. Typical examples of the compounds include those described in JP-A-56-64339, JP-A-57-144547, and JP-A-58-115438.

In the present invention, various kinds of processing solutions can be employed in a temperature range from 10° C. to 50° C. Although a standard temperature is of from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of saving silver employed in the color photographic light-sensitive material, the photographic processing may be conducted utilizing color intensification using cobalt or hydrogen peroxide described in West German Patent No. 2,226,770 or U.S. Pat. No. 3,674,499.

It is preferred that the amount of the replenisher is small in each processing step. Preferably the amount of the replenisher is from 0.1 to 50 times, more preferably from 3 to 30 times the amount of the solution carried over from the preceding bath per unit area of the photographic light-sensitive material.

In order to develop black-and-white photographic light-sensitive materials, known various developing agents can be employed in the present invention. For instance, polyhydroxybenzenes, for example, hydroquinone, 2-chlorohydroquinone, 2-methylhydroquinone, catechol, and pyrogallol; aminophenols, for example, p-aminophenol, N-methyl-p-aminophenol, and 2,4-diaminophenol.; 3-pyrazolidones, for example, 1-phenyl-3pyrazolidone, 1-phenyl-4,4'-dimethyl-3-pyrazolidone, 1-phenyl-4-methyl-4-hydroxymethyl-3-pyrazolidone, and 5,5-dimethyl-1-phenyl-3-pyrazolidone; and ascorbic acids; are employed individually or in a combination. Further, a developing solution described in JP-A-58-55928 may be employed. Such developing agents may be incorporated into an alkaline processing composition (processing element) or an appropriate layer of a light-sensitive element.

The developing solution may contain sodium sulfite, potassium sulfite, ascorbic acid, a reductone (for example, piperidinohexose reductone), etc. as a preservative.

The photographic light-sensitive material according to the present invention can provide direct positive images upon development using a surface developing solution. The surface developing solution has a property in that its development process is substantially invited by a latent image or a fog nucleus positioned on the surface of silver halide grains. Although it is preferred that the surface developing solution does not contain a silver halide solvent, the surface developing solution may contain a silver halide solvent such as a sulfite, as far as an internal latent image does not substantially contribute until the development due to the development center positioned on the surface of silver halide grain is completed.

The developing solution may contain sodium hydroxide, potassium hydroxide, sodium carbonate, potassium carbonate, trisodium phosphate, sodium methaborate, etc. as an alkali agent or a buffering agent. The amounts of these agents is selected so that the pH of the developing solution is adjusted to the range of from 9 to 13, preferably of from 10 to 11.5.

It is advantageous that the developing solution may further contain a compound which is usually employed as an antifoggant, for example, a benzimidazole such as 5-nitrobenzimidazole, a benzotriazole such as benzotriazole and 5-methylbenzotriazole in order to lower the minimum density of direct positive images.

Specific examples and methods for use of developing agents, preservatives, buffering agents and methods of development with respect to black-and-white photographic light-sensitive materials are described, for example, in *Research Disclosure,* No. 17643 (December, 1978), sections XIX to XXI.

In the case of using DRR compounds, any silver halide developing agent (or electron donor) which is capable of cross-oxidation of the DRR compounds may be employed in the present invention.

These developing agents may be incorporated into an alkaline developing solution (processing element) or in an appropriate layer of the photographic element. Examples of developing agents suitable for use in the present invention are illustrated below: hydroquinone, aminophenols (for example, N-methylaminophenol), 1-pheny-3-pyrazolidinone, 1-phenyl-4,4-dimethyl-3-pyrazolidinone, 1-phenyl-4-methyl-4-hydroxymethyl-3-pyrazolidinone, N,N-diethyl-p-phenylenediamine, 3-methyl-N,N-diethyl-p-phenylenediamine, 3-methoxy-N-ethoxy-p-phenylenediamine, etc.

Of these, black-and-white developing agents capable of reducing stains of an image-receiving layer (mordant layer) are generally particularly preferable just as described with respect to the above described alkaline development processing solution.

In applying the photographic light-sensitive material in accordance with the present invention to diffusion transfer process type film units, a viscous developing solution is preferably used. Such a viscous developing solution is a liquid composition containing processing components necessary for developing silver halide emulsions (and forming a diffusion-transferred dye image), in which water is a main solvent, with a hydrophilic solvent such as methanol or methyl cellosolve being sometimes present. The processing composition preferably contains a hydrophilic polymer such as high molecular weight polyvinyl alcohol, hydroxyethyl cellulose, sodium carboxymethylcellulose, etc. These polymers are used so as to impart a viscosity of about 1 poise or more, preferably from about 500 to about 1,000 poises, to the processing composition at room temperature.

The above-described processing composition preferably fills a pressure-rupturable container to be used as described in U.S. Pat. Nos. 2,543,181, 2,643,886, 2,653,732, 2,723,051, 3,056,491, 3,056,492 and 3,152,515.

In accordance with the direct positive image forming method of the present invention, images having both a low minimum image density and an extremely high maximum density can be obtained rapidly and stably using a small amount of nucleating agents, a relative ratio of nucleating rates of which is at least 2.0.

The present invention is now illustrated in greater detail with reference to the following Examples, but the present invention is not to be construed as being limited thereto. Unless otherwise indicated, all parts, percents and ratios are by weight.

EXAMPLE 1

Preparation of Emulsion A

An aqueous solution of potassium bromide and an aqueous solution of silver nitrate were simultaneously added at 75° C. over a period of about 12 minutes with vigorous stirring to an aqueous gelatin solution containing 0.13 g of 3,4-dimethyl-1,3-thiazoline-2-thion per mol of Ag to obtain an octahedral monodispersed silver bromide emulsion having an average grain diameter of 0.35 μm. To the emulsion were added 25 mg each of sodium thiosulfate and chloroauric acid (tetrahydrate) per mol of silver and the emulsion was heated at 75° C. for 80 minutes to be chemically sensitized. The thus prepared silver bromide grains were used as cores and were treated further for 40 minutes while adding additional potassium bromide and silver nitrate under the same precipitation conditions as described above to be further grown thereby producing finally an octahedral monodispersed core/shell silver bromide emulsion having an average grain diameter of 0.6 μm. The emulsion was washed with water and desalted, then 3.0 mg of each of sodium thiosulfate and chloroauric acid (tetrahydrate) per mol of silver were added thereto, and the emulsion was heated at 60° C. for 60 minutes to be chemically sensitized thereby producing an internal latent image type silver halide emulsion A.

Using the core/shell type internal latent image emulsion, a multilayer color printing paper (Sample 101) having the layer structure shown in Table 1 below was prepared using a paper support both surfaces of which were laminated with polyethylene. The coating solutions were prepared as follows.

Preparation of Coating Solution for First Layer 10 g of Cyan coupler (a) and 2.3 g of Dye image stabilizer (b) were dissolved in 10 ml of ethyl acetate and 4 ml of Solvent (c). The resulting solution was emulsified and dispersed in 90 ml of a 10% aqueous gelatin solution containing 5 ml of a 10% aqueous solution of sodium dodecylbenzenesulfonate, to prepare an emulsified dispersion. Separately, to the above described silver halide emulsion (containing 70 g of Ag/kg) was added a red-sensitive dye shown below in an amount of $2.0\times10^{-4}$ mol per mol of the silver halide to produce 90 g of a red-sensitive emulsion. The emulsified dispersion, the red-sensitive emulsion, and a development accelerator were mixed and dissolved and the concentrations were adjusted using gelatin to have the composition shown in Table 1, and further the nucleating agent shown in Table 2 below in the amount shown in Table 2 below was added thereto to prepare a coating solution for the first layer.

Coating solutions for the second layer to seventh layer were prepared in the same manner as the coating solution for the first layer. As a gelatin hardener for each layer 1-oxy-3,5-dichloro-s-triazine sodium salt was employed.

TABLE 1

| Layer | Main Components | Amount |
|---|---|---|
| Seventh Layer (Protective layer) | Gelatin | 1.33 g/m$^2$ |
| | Latex particles of polymethylmethacrylate (average particle diameter: 2.8 μm) | 0.05 g/m$^2$ |
| | Acryl-modified copolymer of polyvinyl alcohol (degree of | 0.17 g/m$^2$ |

TABLE 1-continued

| Layer | Main Components | Amount |
|---|---|---|
| | modification: 17%) | |
| Sixth Layer (Ultraviolet absorbing layer) | Gelatin | 0.54 g/m$^2$ |
| | Ultraviolet absorber (i) | $5.10 \times 10^{-4}$mol/m$^2$ |
| | Solvent (k) | 0.08 g/m$^2$ |
| Fifth Layer (Blue-sensitive layer) | Emulsion | 0.40 g/m$^2$ (as silver) |
| | Gelatin | 1.35 g/m$^2$ |
| | Yellow Coupler (l) | $6.91 \times 10^{-4}$mol/m$^2$ |
| | Color image stabilizer (m) | 0.13 g/m$^2$ |
| | Solvent (h) | 0.02 g/m$^2$. |
| | Development accelerator (d) | 32 g/m$^2$ |
| | Nucleation accelerating agent | $3.7 \times 10^{-7}$mol/m$^2$ |
| Fourth Layer (Ultraviolet absorbing layer) | Gelatin | 1.60 g/m$^2$ |
| | Colloidal silver | 0.10 g/m$^2$ (as silver) |
| | Ultraviolet absorber (i) | $1.70 \times 10^{-4}$mol/m$^2$ |
| | Color mixing preventing agent (j) | $1.60 \times 10^{-4}$mol/m$^2$ |
| | Solvent (k) | 0.24 g/m$^2$ |
| Third Layer (Green-sensitive layer) | Emulsion | 0.39 g/m$^2$ (as silver) |
| | Gelatin | 1.56 g/m$^2$ |
| | Magenta coupler (f) | $4.60 \times 10^{-4}$mol/m$^2$ |
| | Color image stabilizer (g) | 0.14 g/m$^2$ |
| | Solvent (h) | 0.42 g/m$^2$ |
| | Development accelerator (d) | 32 mg/m$^2$ |
| | Nucleation accelerating agent | $3.6 \times 10^{-7}$mol/m$^2$ |
| Second Layer (Color mixing preventing layer) | Gelatin | 0.90 g/m$^2$ |
| | Colloidal silver | 0.02 g/m$^2$ (as silver) |
| | Color mixing preventing agent (e) | $2.33 \times 10^{-4}$mol/m$^2$ |
| First Layer (Red-sensitive layer) | Emulsion | 0.39 g/m$^2$ (as silver) |
| | Gelatin | 0.90 g/m$^2$ |
| | Cyan coupler (a) | $7.05 \times 10^{-4}$mol/m$^2$ |
| | Color image stabilizer (b) | $5.20 \times 10^{-4}$mol/m$^2$ |
| | Solvent (c) | 0.22 g/m$^2$ |
| | Development accelerating (d) | 32 mg/m$^2$ |
| | Nucleation accelerating agent | $3.6 \times 10^{-7}$mol/m$^2$ |
| Support | polyethylene-laminated paper [the polyethylene on the first layer side contained white pigments ($TiO_2$, etc.) and bluish dyes (ultramarine, etc,); thickness: 100 μm] | |
| Curling preventing layer | Gelatin | 2.70 g/m$^2$ |

The spectral sensitizers for the emulsions used are described below.

Red sensitive dye:

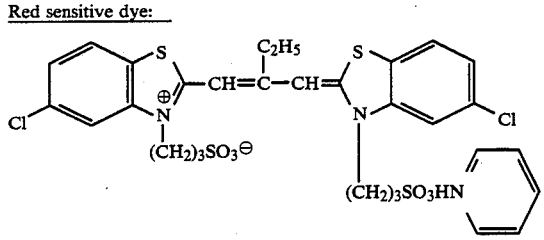

Green sensitive dye:

-continued

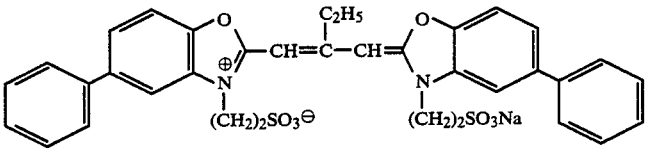

Blue sensitive dye:

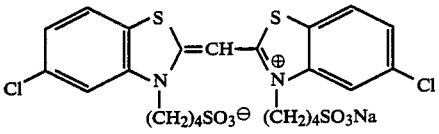

The following dyes were used as irradiation preventive dyes.

Irradiation preventing dye for the green-sensitive emulsion:

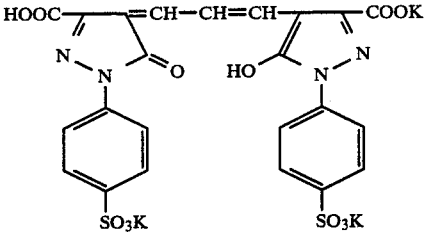

Irradiation preventing dye for the red-sensitive emulsion:

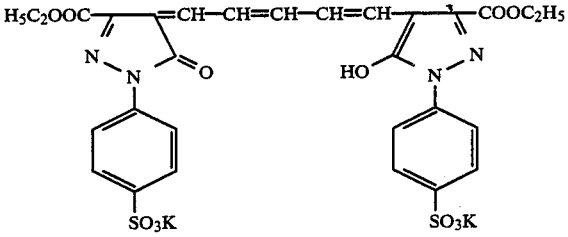

The structures of the compounds used in this example including couplers are shown below.

(a) Cyan coupler:

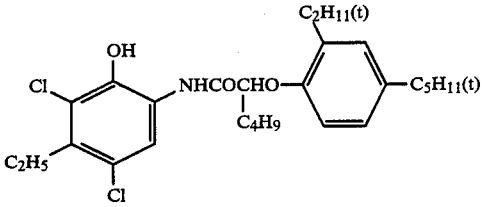

(b) Color image stabilizer:

a 1:3:3 (by mol) mixture of

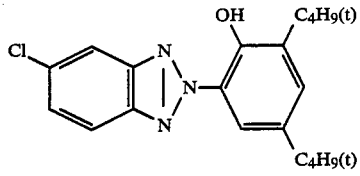

-continued

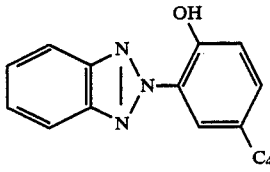

and

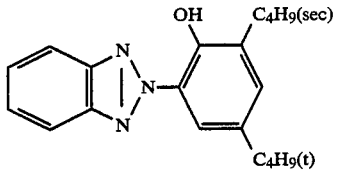

(c) Solvent

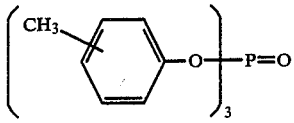

(d) Development accelerator

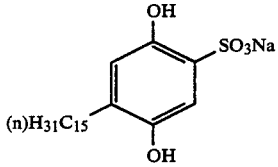

(e) Color mixing preventing agent:

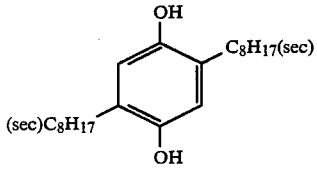

(f) Magenta coupler:

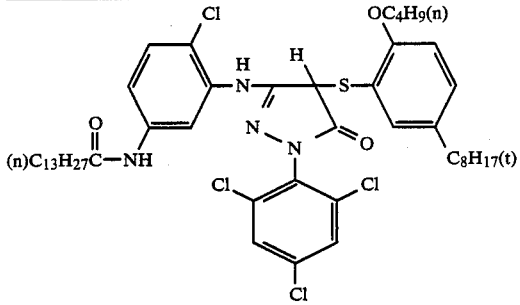

-continued (g) Color image stabilizer:

a 1:5 (by weight) mixture of

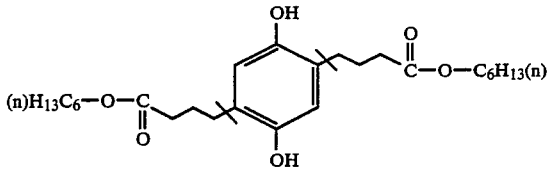

and

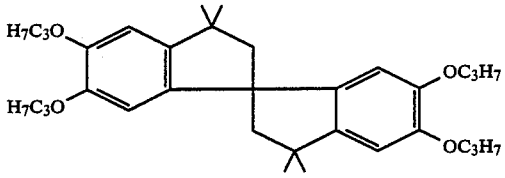

(h) Solvent:

a 1:2:2 (by weight) mixture of

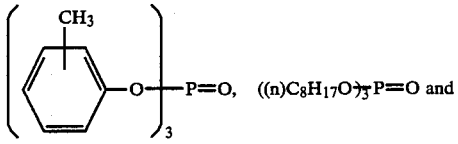

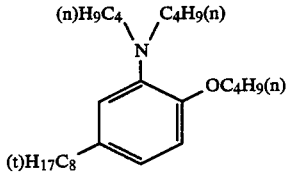

(i) Ultraviolet absorber:

a 1:5:3 (by mol) mixture of

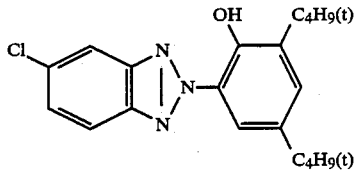

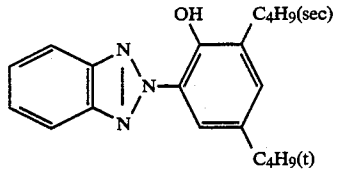

and

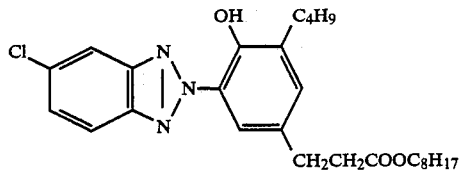

(j) Color mixing preventing agent:

-continued

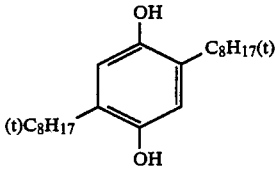

(k) Solvent:

$(iso C_9H_{19}O)_3P{=}O$ (l) Yellow coupler:

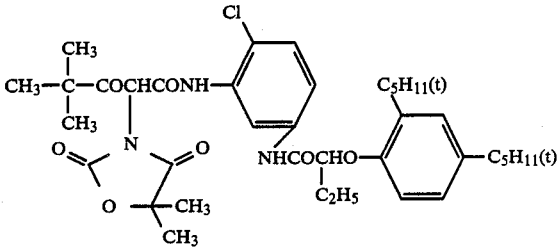

(m) Color image stabilizer:

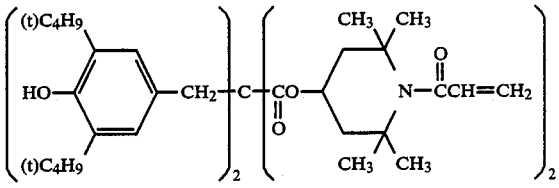

Nucleation accelerating agent:

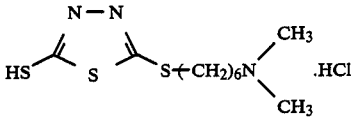

Preparation of Samples 102 to 113

Samples 102 to 113 were prepared in the same manner as described for Sample 101 but using the compounds shown in Table 2 below in the amounts shown in Table 2 below in place of the nucleating agent used in the first layer, the third layer and the fifth layer of Sample 101 respectively.

After each of the thus prepared color printing papers was subjected to wedge exposure (1/10 sec, 10 CMS), the printing paper was subjected to development processing according to the steps described below. Cyan, magenta and yellow densities of the color images thus formed were measured.

| Processing Step | Time | Temperature |
|---|---|---|
| Color development | 1 min 40 sec | 37° C. |
| Bleach-fixing | 40 sec | 37° C. |
| Stabilizing (1) | 20 sec | 37° C. |
| Stabilizing (2) | 20 sec | 37° C. |
| Stabilizing (3) | 20 sec | 37° C. |

The replenishing method of the stabilizing bath was a countercurrent replenishing method, i.e., the replenishing solution was supplied to stabilizing bath (3), the overflow from stabilizing bath (3) was introduced to stabilizing bath (2), and the overflow from stabilizing bath (2) was introduced to stabilizing bath (1).

The composition of each processing solution used was as follows.

| Color Developing Solution | Tank Solution |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-methyl-4-amino-N-ethyl-β-methane-sulfonamidoethyl)aniline sulfate | 4.25 g |
| Potassium carbonate | 30.0 g |
| Fluorescent brightening agent (stilbene type) | 1.0 g |
| Water to make | 1000 ml |
| pH | 10.20 |

The pH was adjusted using potassium hydroxide or hydrochloric acid.

| Bleach-fixing Solution | Tank Solution |
|---|---|
| Ammonium thiosulfate | 110 g |
| Sodium hydrogensulfite | 10 g |
| Ammonium diethylenetriaminepentaacetatio)-iron (III) monohydrate | 56 g |
| Disodium (ethylenediaminetetraacetate dihydrate | 5 g |
| 2-Mercapto-1,3,4-triazole | 0.5 g |
| Water to make | 1000 ml |
| pH | 6.5 |

The pH was adjusted using aqueous ammonia or hydrochloric acid.

| Stabilizing Solution | Tank Solution |
|---|---|
| 1-Hydroxyethylidene-1,1'-diphosphonic acid (60%) | 1.6 g |

-continued

| Stabilizing Solution | Tank Solution |
|---|---|
| Bismuth chloride | 0.35 g |
| polyvinyl pyrrolidone | 0.25 g |
| Aqueous ammonia | 2.5 ml |
| Trisodium nitrilotriacetate | 1.0 g |
| 5-chloro-2-methyl-4-isothiazolin-3-one | 50 mg |
| 2-octyl-4-isothiazolin-3-one | 50 mg |
| Fluorescent brightening agent (4,4'-diaminostilbene type) | 1.0 g |
| Water to make | 1000 ml |
| pH | 7.5 |

The pH was adjusted using potassium hydroxide or hydrochloric acid.

TABLE 2

| Sample No. | Nucleating Agent No. | Nucleating Agent Amount Added (mol/mol Ag) | Relative Ratio of Nucleating Rates | Cyan $D_{max}$ | Cyan $D_{min}$ | Magenta $D_{max}$ | Magenta $D_{min}$ | Yellow $D_{max}$ | Yellow $D_{min}$ |
|---|---|---|---|---|---|---|---|---|---|
| 101 (Comprison) | N-I-9 | $5.0 \times 10^{-6}$ | — | 2.39 | 0.31 | 2.38 | 0.29 | 2.35 | 0.32 |
| 102 (Comprison) | N-I-15 | " | — | 1.85 | 0.15 | 1.67 | 0.14 | 1.65 | 0.14 |
| 103 (Comprison) | N-I-18 | " | — | 2.45 | 0.33 | 2.40 | 0.32 | 2.39 | 0.35 |
| 104 (Comprison) | N-II-6 | $1.0 \times 10^{-4}$ | — | 1.37 | 0.15 | 1.26 | 0.14 | 1.11 | 0.14 |
| 105 (Comprison) | N-I-19 | $5.0 \times 10^{-6}$ | — | 2.46 | 0.33 | 2.43 | 0.32 | 2.41 | 0.33 |
| 106 (Comprison) | N-II-7 | $1.0 \times 10^{-4}$ | — | 1.44 | 0.15 | 1.35 | 0.14 | 1.20 | 0.14 |
| 107 (Comprison) | N-I-19/N-I-18 | $2.5 \times 10^{-6}/2.5 \times 10^{-6}$ | 1.5 | 2.45 | 0.33 | 2.41 | 0.30 | 2.39 | 0.33 |
| 108 (Comprison) | N-I-18/N-I-9 | " | 1.8 | 2.43 | 0.32 | 2.39 | 0.31 | 2.37 | 0.34 |
| 109 (Invention) | N-I-9/N-I-15 | " | 2.1 | 2.37 | 0.15 | 2.34 | 0.15 | 2.32 | 0.15 |
| 110 (Invention) | N-I-19/N-I-15 | " | 5.7 | 2.45 | 0.15 | 2.42 | 0.15 | 2.40 | 0.15 |
| 111 (Invention) | N-I-18/N-II-6 | $2.5 \times 10^{-6}/1.0 \times 10^{-4}$ | 213 | 2.46 | 0.14 | 2.41 | 0.14 | 2.42 | 0.14 |
| 112 (Invention) | N-I-19/N-II-7 | " | 42 | 2.45 | 0.15 | 2.42 | 0.15 | 2.39 | 0.14 |
| 113 (Invention) | N-I-19/N-II-6 | " | 320 | 2.46 | 0.15 | 2.43 | 0.15 | 2.40 | 0.14 |

EXAMPLE 2

Core/shell type Emulsions B and C were prepared in the following manner.

Emulsion B

An aqueous solution of potassium bromide and an aqueous solution of silver nitrate were simultaneously added at 40° C. over a period of about 20 minutes with vigorous stirring to an aqueous gelatin solution, to obtain a cubic monodispersed silver bromide emulsion having an average grain diameter of 0.08 μm. To the emulsion were added 580 mg of each of sodium thiosulfate and chloroauric acid (tetrahydrate) per mol of silver, and the emulsion was heated at 75° C. for 80 minutes to be chemically sensitized. The thus prepared silver bromide grains were used as cores and were treated while adding additional potassium bromide and silver nitrate under the same precipitation conditions described above except for controlling the pAg of the solution to 7.90 to be further grown thereby producing finally a cubic monodispersed core/shell type silver bromide emulsion having an average grain diameter of 0.18 mμ. The emulsion was washed with water and desalted, then 6.2 mg of each of sodium thiosulfate and chloroauric acid (tetrahydrate) were added at 65° C. for 60 minutes to be chemically sensitized thereby producing Emulsion B.

Emulsion C

An aqueous solution of potassium bromide and an aqueous solution of silver nitrate were simultaneously added at 75° C. over a period of about 40 minutes with vigorous stirring to an aqueous gelatin solution, to obtain an octahedral monodispersed silver bromide emulsion having an average grain diameter of 0.4 μm. To the emulsion were added 4 mg of each of sodium thiosulfate and chloroauric acid (tetrahydrate) per mol of silver and the emulsion was heated at 75° C. for 80 minutes to be chemically sensitized. The thus prepared silver bromide grains were used as cores and were treated further for 40 minutes while adding additional potassium bromide and silver nitrate under the same precipitation conditions described above to be further grown thereby producing finally an octahedral monodispersed core/shell silver bromide emulsion having an average grain diameter of 0.6 mμ. The emulsion was washed with water and desalted, then 0.9 mg of sodium thiosulfate per mol of silver was added thereto and the emulsion was heated at 65° C. for 60 minutes to be chemically sensitized thereby producing an internal latent image type silver halide Emulsion C.

To the core/shell type Emulsions B and C, were added Sensitizing dye I in amounts of 140 mg and 220 mg per mol of silver, respectively, and the compounds shown in Table 3 below in the amounts shown in Table 3 below, respectively, and then Emulsion B and Emulsion C were coated on a support as an under layer and an upper layer respectively so as to have a composition that the coating amounts of silver were 1.0 g/m$^2$ and 1.5 g/m$^2$ and the coating amounts of gelatin were 1.3 g/m$^2$ and 2.4 g/m$^2$, respectively. On the emulsion layer was further coated a gelatin protective layer so as to make the coating amount of gelatin 1.7 g/m$^2$. To the emulsion layers and the gelatin protective layer was added sodium dodecylbenzenesulfonate as a coating aid. Thus Sample 201 was prepared.

Preparation of Samples 202 to 209

Samples 202 to 209 were prepared in the same manner as described for Sample 201 except for using the compounds shown in Table 3 below in the amounts shown in Table 3 below in place of the nucleating agent used in Sample 201, respectively.

Sensitizing dye I:

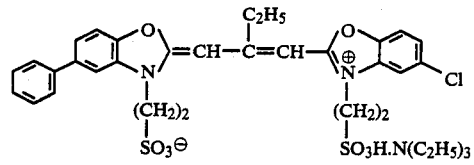

These samples thus prepared were exposed to tungsten light of 1 KW at a color temperature of 2854° K. for 1 second through a step wedge and then developed at 36° C. for 1 minute using a developing solution shown below, followed by stopping, fixing and washing with water in a conventional manner to obtain positive images.

| Developing Solution | |
|---|---|
| Hydroquinone | 45 g |
| Sodium sulfite | 100 g |
| Potassium carbonate | 20 g |
| Sodium bromide | 3 g |
| 1-Phenyl-4-methyl-4-hydroxymethyl-3-pyrazolidone | 3 g |
| 5-Methylbenzotriazole | 40 mg |
| Water to make | 1 liter |

pH was adjusted to 11.8 with potassium hydroxide. The results obtained are shown in Table 3 below.

TABLE 3

| Sample No. | Nucleating Agent No. | Nucleating Agent Amount Added (Mol/mol Ag) | Relative Ratio of Nucleating Rates | D max | D min |
|---|---|---|---|---|---|
| 201 (Comparison) | N-I-20 | $5.0 \times 10^{-6}$ | — | 2.51 | 0.24 |
| 202 (Comparison) | N-II-6 | $1.0 \times 10^{-4}$ | — | 1.42 | 0.14 |
| 203 (Comparison) | N-II-7 | " | — | 2.18 | 0.14 |
| 204 (Comparison) | N-II-30 | " | — | 1.27 | 0.13 |
| 205 (Comparison) | N-I-19 | $5.0 \times 10^{-6}$ | — | 2.49 | 0.24 |
| 206 (Comparison) | N-I-20/N-I-19 | $2.5 \times 10^{-6}/2.5 \times 10^{-6}$ | 1.9 | 2.50 | 0.24 |
| 207 (Invention) | N-II-27/N-II-21 | $2.5 \times 10^{-6}/1.0 \times 10^{-4}$ | 15 | 2.49 | 0.14 |
| 208 (Invention) | N-II-7/N-II-30 | $1.0 \times 10^{-4}/1.0 \times 10^{-4}$ | 85 | 2.41 | 0.14 |
| 209 (Invention) | N-I-20/N-II-7 | $2.5 \times 10^{-6}/1.0 \times 10^{-4}$ | 80 | 2.49 | 0.15 |

EXAMPLE 3

Preparation of core/shell type direct positive emulsion: Emulsion D

An aqueous solution of potassium bromide and an aqueous solution of silver nitrate were simultaneously added at 75° C. over a period of about 60 minutes with vigorous stirring to an aqueous gelatin solution to obtain a silver bromide emulsion. Before the precipitation, 100 mg of 3,4-dimethyl-1,3-thiazoline-2-thione per mol of silver and 15 g of benzimidazole per mol of silver were added to the precipitation vessel. After the completion of the precipitation, silver bromide grains having an average grain diameter of 1.1 μm were formed. Sodium thiosulfate and potassium chloroaurate were added to the silver bromide emulsion, and the emulsion was heated at 75° C. for 80 minutes to be chemically sensitized. The thus prepared silver bromide grains were used as cores and were treated further for 40 minutes while adding additional solutions of potassium bromide and silver nitrate, respectively, under the same precipitation conditions described above to be further grown thereby producing a core/shell emulsion. The final average grain diameter of the emulsion was 1.5 μm.

To the core/shell type emulsion were added sodium thiosulfate and poly(N-vinylpyrrolidone) and the emulsion was heated at 60° C. for 60 minutes to be chemically sensitized on the surface of the grains. (Emulsion D)

Emulsion E

Equimolar aqueous solutions of potassium bromide and silver nitrate were mixed simultaneously at 75° C. over a period of about 30 minutes to prepare a silver bromide emulsion having an average grain diameter of 0.5 μm. To the silver bromide emulsion were added 3.5 mg of sodium thiosulfate per mol of silver, 5.4 mg of potassium chloroaurate per mol of silver and 0.8 mg of lead nitrate per mol of silver, and the emulsion was heated at 75° C. for 60 minutes to be chemically sensitized. The thus prepared silver bromide grains were treated further for 50 minutes while adding additional potassium bromide and silver nitrate under the same precipitation conditions described above to be further grown thereby producing a silver bromide emulsion. The final average grain diameter of the emulsion was 0.8 μm.

To the core/shell type emulsion were then added sodium thiosulfate, potassium chloroaurate, and poly(N-vinylpyrrolidone), and the emulsion was then heated at 60° C. for 60 minutes to be chemically sensitized on the surface of the grains. (Emulsion E)

Emulsion F

Equimolar aqueous solutions of potassium bromide and silver nitrate were mixed simultaneously at 75° C. over a period of about 40 minutes to prepare a silver bromide emulsion having an average grain diameter of 0.6 μm. To the silver bromide emulsion were added 2.7 mg of sodium thiosulfate per mol of silver, 3.6 mg of potassium chloroaurate per mol of silver and 0.8 mg of lead nitrate per mol of silver, and the emulsion was heated at 75° C. for 60 minutes to be chemically sensitized. The thus prepared silver bromide grains were treated further for 50 minutes while adding additional potassium bromide and silver nitrate under the same precipitation conditions described above to be further grown thereby producing a silver bromide emulsion. The final average grain diameter of the emulsion was 1.0 μm.

To the core/shell type emulsion were added, sodium thiosulfate, potassium chloroaurate and poly(N-vinylpyrrolidone), and the emulsion was then heated at 60° C. for 60 minutes to be chemically sensitized on the surface of the grains. (Emulsion F)

On a polyethylene terephthalate transparent support, Layer (1) to Layer (21) were coated according to the layer structure shown below to prepare a light-sensitive sheet which was designated Sample 301.

Layer 21: Protective layer containing gelatin
Layer 20: ultraviolet absorbing layer
Layer 19: Blue-sensitive core/shell type direct positive emulsion layer
Layer 18: Blue-sensitive core/shell direct positive emulsion layer-2
Layer 17: White light reflective layer
Layer 16: Layer containing a yellow DRR compound
Layer 15: Intermediate layer containing gelatin
Layer 14: Color mixing preventing layer
Layer 13: Green-sensitive core/shell type direct positive emulsion layer
Layer 12: Green-sensitive core/shell type direct positive emulsion layer-2
Layer 11: White light reflective layer
Layer 10: Layer containing a magenta DRR compound
Layer 9 : Intermediate layer containing gelatin
Layer 8 : Color mixing preventing layer
Layer 7 : Red-sensitive core/shell type direct positive emulsion layer
Layer 6 : Red-sensitive core/shell type direct positive emulsion layer-2
Layer 5 : White light reflective layer
Layer 4 : Layer containing a cyan DRR compound
Layer 3 : Light shielding layer
Layer 2 : White-light reflective layer
Layer 1 : Mordanting layer
Layer 1 : Mordanting layer containing a copolymer having the repeating unit described below in the ratio described below:

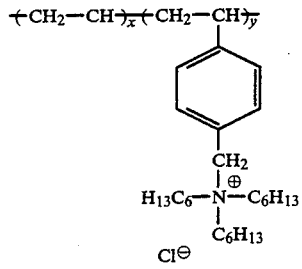

x:y=50:50 which is described in U.S. Pat. No. 3,898,088 (3.0 g/m²) and gelatin (3.0 g/m²).

Layer 2 White-light reflective layer containing titanium oxide (20 g/m²) and gelatin (2.0 g/m²)

Layer 3 : Light shielding layer containing carbon black (2.0 g/m²) and gelatin (1.5 g/m²)

Layer 4 : Layer containing the following cyan DRR compound (0.44 g/m²), tricyclohexyl phosphate (0.09 g/m²) and gelatin (0.8 g/m²)

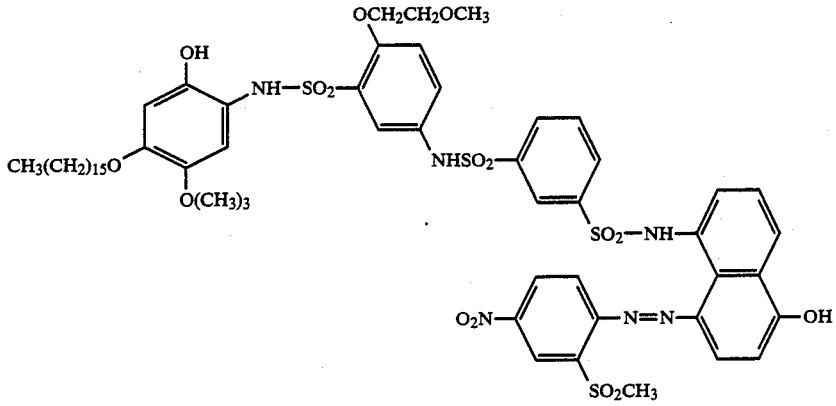

Layer 5 : White light reflective layer containing titanium oxide (2.8 g/m$^2$) and gelatin (1.0 g/m$^2$).

Layer 6 : Red-sensitive core/shell type direct positive silver bromide emulsion layer containing Emulsion D (1.0 g/m$^2$ as silver), the following red-sensitizing dye (0.018 mg/m$^2$), a compound shown in Table 4 below in an amount shown in Table 4 below as a nucleating agent, 4-hydroxy-6-methyl-1,3,3a,7-tetraazaindene (5.3 mg/m$^2$) and sodium 5-pentadecyl hydroquinone-2-sulfonate (0.12 g/m$^2$).

Red-sensitizing dye:

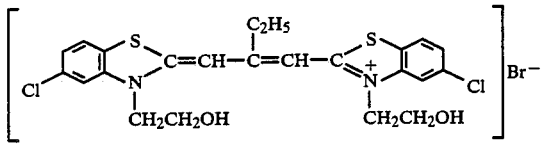

Layer 7 : Red-sensitive core/shell silver bromide emulsion layer containing Emulsion E (0.27 g/m$^2$ as silver), the same red-sensitizing dye as used in Layer 6 (0.04 mg/m$^2$), a compound shown in Table 4 below as a nucleating agent, 4-hydroxy-6-methyl-1,3,3a,7-tetraazaindene (1.4 mg/m$^2$) and sodium 5-pentadecyl hydroquinone-2-sulfonate (0.03 g/m$^2$).

Layer 8 : Color mixing preventing layer containing 2,5-di-tert-pentadecyl hydroquinone (1.0 g/m$^2$) and gelatin (0.8 g/m$^2$).

Layer 9 : Intermediate layer containing gelatin (0.18 g/m$^2$).

Layer 10: Layer containing a magenta DRR compound of structural formula I shown below (0.21 g/m$^2$), a magenta DRR compound of structural formula II shown below (0.11 g/m$^2$), tricyclohexyl phosphate (0.08 g/m$^2$) and gelatin (0.9 g/m$^2$).

Structural formula I:

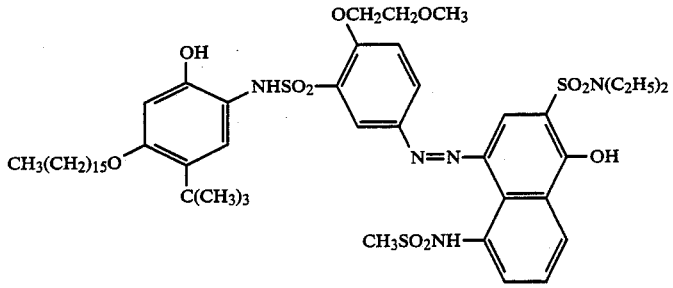

Structural formula II:

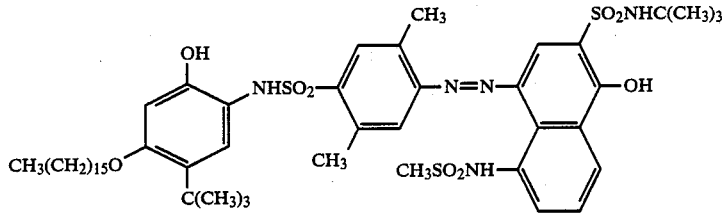

Layer 11: White light reflective layer containing titanium oxide (1.0 g/m$^2$) and gelatin (0.36 g/m$^2$)

Layer 12: Green-sensitive core/shell type direct positive silver bromide emulsion layer containing Emulsion D (0.55 g/m$^2$ as silver), the following green-sensitizing dye (0.12 mg/m$^2$), the same nucleating agent as used in Layer 6, 4-hydroxy-6-methyl-1,3,3a,7-tetraazaindene (3.2 mg/m$^2$) and sodium 5-pentadecyl hydroquinone-2-sulfonate (0.07 g/m$^2$)

Green sensitizing dye:

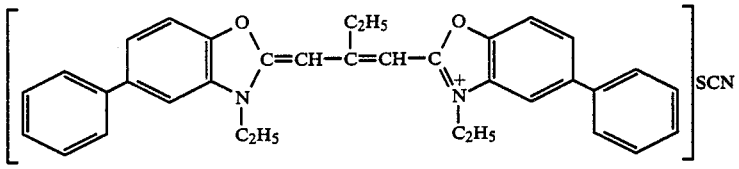

Layer 13: Green-sensitive core/shell type direct positive silver bromide emulsion layer containing Emulsion E (0.15 g/m$^2$ as silver), the same green-sensitizing dye as used in Layer 12 (0.03 mg/m$^2$), a nucleating agent as shown in Table 4 below in an amount shown in Table 4 below, 4-hydroxy-6-methyl-1,3,3a,7-tetraazaindene (0.21 mg/m$^2$) and sodium 5-pentadecyl hydroquinone-2-sulfonate (0.02 g/m$^2$)

Layer 14: Same as Layer 8 above

Layer 15: Same as Layer 9 above

Layer 16: Layer containing the following yellow DRR compound (0.53 g/m$^2$), tricyclohexyl phosphate (0.13 g/m$^2$) and gelatin (0.7 g/m$^2$)

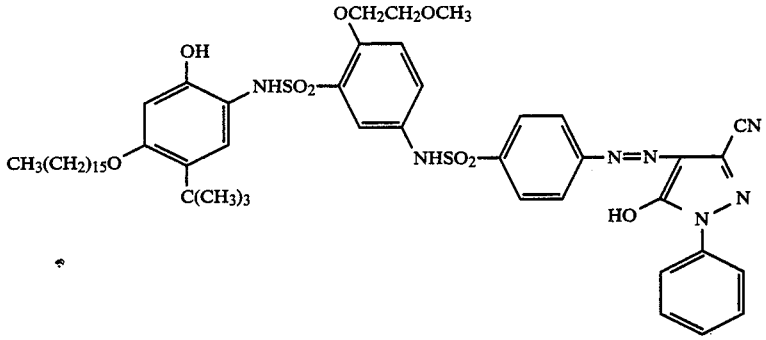

Layer 17: White light reflective layer containing titanium oxide (0.6 g/m$^2$) and gelatin (0.21 g/m$^2$)

Layer 18: Blue-sensitive core/shell type direct positive silver bromide emulsion layer containing Emulsion D (1.00 g/m$^2$ as silver), the same compound as used in Layer 6 as a nucleating agent, 4-hydroxy-6-methyl-1,3,3a,7-tetraazaindene (4.1 mg/m$^2$) and sodium 5-pentadecylhydroquinone-2-sulfonate (0.06 g/m$^2$)

Layer 19: Blue-sensitive core/shell type direct positive silver bromide emulsion layer containing Emulsion E (0.27 g/m$^2$ as silver), the same compound as used in Layer 6 as a nucleating agent, 4-hydroxy-6-methyl-1,3,3a,7-tetraazaindene (1.1 mg/m$^2$) and sodium 5-pentadecylhydoquinone-2-sulfonate (0.015 g/m$^2$)

Layer 20: Ultraviolet absorbing layer containing $4\times10^{-4}$ mol/m$^2$ of each of the following ultraviolet absorbers and gelatin (0.50 g/m$^2$)

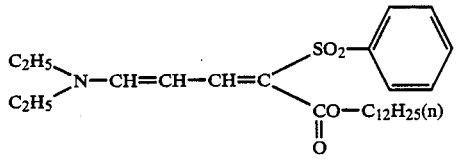

-continued

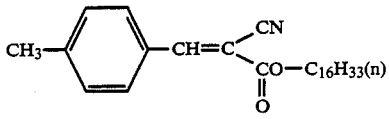

Layer 21: Protective layer containing polymethyl methacrylate latex (average particle size: 4 μm) (0.10 g/m$^2$), gelatin (0.8 g/m$^2$) and triacryloyltriazine as a hardener (0.02 g/m$^2$)

Cover Sheet

On a polyethylene terephthalate transparent support, Layer (1) to Layer (3) described below were coated in this order to prepare a color sheet.

Layer (1) Neutralizing layer containing copolymer of acrylic acid and butyl acrylate (weight ratio: 80/20) (22 g/m$^2$) and 1,4-bis (2,3-epoxypropoxy) butane (0.44 g/m$^2$)

Layer (2) Layer containing acetyl cellulose (as modified by hydrolysis of 100 g acetyl cellulose to form 39.4 g of acetyl group (3.8 g/m$^2$), a copolymer of styrene and maleic anhydride (weight ratio: 60/40, molecular weight: about 50,000) (0.2 g/m$^2$) and 5-(β-cyanoethylthio)-1-phenyl-tetrazole (0.115 g/m$^2$)

Layer (3) Layer containing a copolymer latex of vinylidene chloride, methyl acrylate and acrylic acid (weight ratio: 85/12/3) (2.5 g/m$^2$) and a polymethyl methacrylate latex (particle size: 1 to 3 μm) (0.05 g/m$^2$)

Processing Solution 1-p-Tolyl-4-methyl-4-hydroxymethyl-3-pyrazolidone: 12.0 g
Methylhydroquinone: 0.3 g
5-Methylbenzotriazole: 3.5 g
Sodium sulfite: 2.0 g
Sodium carboxymethyl cellulose: 58 g
Potassium hydroxide: 56 g
Benzyl alcohol: 1.5 g
Carbon black dispersion (25%): 600 g
Water to make: 1 kg 0.8 g portions of the processing solution having the above described composition were retained in "pressure-rupturable containers".

Preparation of Samples 302 to 310

Samples 302 to 310 were prepared in the same manner as described for Sample 301 except for using the compounds shown in Table 4 below in the amount shown in Table 4 below in place of the nucleating agent used in Sample 301, respectively.

Exposure to Light and Development Processing

The above described cover sheet was superposed on each of the above described light-sensitive sheets, and image exposure was conducted through a continuous gradation wedge from the cover sheet side. Then, the above described processing solution was spread in a thickness of 75 μm between these two sheets using pressure-applying rollers. The spread processing was conducted at 25° C. The results thus obtained are shown in Table 4 below.

TABLE 4

| Sample No. | Nucleating Agent No. | Nucleating Agent Amount Added (mol/mol Ag) | Relative Ratio of Nucleating Rates | Cyan $D_{max}$ | Cyan $D_{min}$ | Magenta $D_{max}$ | Magenta $D_{min}$ | Yellow $D_{max}$ | Yellow $D_{min}$ |
|---|---|---|---|---|---|---|---|---|---|
| 301 (Comprison) | N-II-26 | $1.0 \times 10^{-4}$ | — | 1.85 | 0.32 | 1.87 | 0.33 | 1.80 | 0.31 |
| 302 (Comprison) | N-II-16 | " | — | 0.93 | 0.14 | 0.94 | 0.14 | 0.89 | 0.13 |
| 303 (Comprison) | N-II-27 | " | — | 1.76 | 0.31 | 1.77 | 0.31 | 1.75 | 0.30 |
| 304 (Comprison) | N-II-21 | " | — | 0.74 | 0.14 | 0.78 | 0.14 | 0.69 | 0.14 |
| 305 (Comprison) | N-I-20 | $5.0 \times 10^{-6}$ | — | 1.95 | 0.36 | 1.94 | 0.35 | 1.89 | 0.35 |
| 306 (Comprison) | N-II-6 | $1.0 \times 10^{-4}$ | — | 1.15 | 0.16 | 1.19 | 0.16 | 1.14 | 0.14 |
| 307 (Comprison) | N-II-26/N-II-27 | $5.0 \times 10^{-5}/1.0 \times 10^{-4}$ | 1.8 | 1.79 | 0.32 | 1.80 | 0.32 | 1.77 | 0.31 |
| 308 (Invention) | N-II-27/N-II-16 | " | 4.5 | 1.83 | 0.14 | 1.87 | 0.14 | 1.78 | 0.14 |
| 309 (Invention) | N-II-27/N-II-21 | " | 15 | 1.75 | 0.14 | 1.78 | 0.14 | 1.77 | 0.14 |
| 310 (Invention) | N-I-20/N-II-6 | " | 610 | 1.89 | 0.17 | 1.93 | 0.16 | 1.91 | 0.15 |

EXAMPLE 4

The following First layer to Fourteenth layer were coated on the front side of a paper support (having a thickness of 100 μm), both surfaces of which were laminated with polyethylene, and the following Fifteenth layer to Sixteen layer were coated on the back side of the paper support, to prepare a color photographic light-sensitive material. The polyethylene laminated on the First layer side of the support contained titanium dioxide as a white pigment and a small amount of ultramarine as a bluish dye.

Construction of Layers

The composition of each layer is shown below. The coating amounts of the components are expressed in terms of g/m². With respect to silver halide, the coating amount is indicated in terms of a silver coating amount. The emulsion used in each layer was prepared according to the method for preparation of Emulsion EM1. The emusion used in the Fourteenth layer was a Lippmann emulsion not being chemically sensitized on the surfaces of grains.

| | |
|---|---|
| First Layer: Antihalation layer | |
| Black colloidal silver | 0.10 |
| Gelatin | 0.70 |
| Second Layer: Intermediate Layer | |
| Gelatin | 0.70 |
| Third Layer: Low-Sensitive Red-Sensitive Layer | |
| Silver bromide emulsion spectrally sensitized with Red-sensitizing dyes (ExS-1, 2, 3) (average grain size: 0.3 μm, size distribution (coefficient of variation): 8%, octahedral) | 0.06 |
| Silver bromide emulsion spectrally sensitized with Red-sensitizing dyes (ExS-1, 2, 3) (average grain size: 0.45 μm, size distribution: 10%, octahedral) | 0.10 |
| Gelatin | 1.00 |
| Cyan coupler (ExC-1) | 0.11 |
| Cyan coupler (ExC-2) | 0.10 |
| Color fading preventing agent (equal amounts of Cpd-2, 3, 4, 13) | 0.12 |
| Coupler dispersing medium (Cpd-5) | 0.03 |
| Coupler solvent (equal amounts of Solv-7, 2, 3,) | 0.06 |
| Fourth Layer: High-Sensitive Red-Sensitive Layer | |
| Silver bromide emulsion spectrallly sensitized with Red-sensitizing dyes (ExS-1, 2, 3) (average grain size: 0.06 μm, size distribution: 15%, octahedral) | 0.14 |
| Gelatin | 1.00 |
| Cyan coupler (ExC-1) | 0.15 |
| Cyan coupler (ExC-2) | 0.15 |
| Color fading preventing agent (equal amounts of Cpd-2, 3, 4, 13) | 0.15 |
| Coupler dispersing medium (Cpd-5) | 0.03 |
| Coupler solvent (equal amounts of Solv-7, 2, 3) | 0.10 |
| Fifth Layer: Intermediate Layer | |
| Gelatin | 1.00 |
| Color mixing preventing agent (Cpd-7) | 0.08 |
| Color mixing preventing agent solvent (equal amounts of Solv-4, 5) | 0.16 |
| Polymer latex (Cpd-8) | 0.10 |
| Sixth Layer: Low-Sensitive Green-Sensitive Layer | |
| Silver bromide emulsion spectrally sensitized with Green-sensitizing dye (ExS-3) (average grain size: 0.25 μm, size distribution: 8%, octahedral) | 0.04 |
| Silver bromide emulsion spectrally sensitized with Green-sensitizing dyes | 0.06 |

-continued

| | |
|---|---|
| (ExS-3, 4) (average grain size: 0.45 μm, size distribution: 11%, octahedral) | |
| Gelatin | 0.80 |
| Magenta coupler (equal amounts of ExM-1, 2) | 0.11 |
| Color fading preventing agent (Cpd-9) | 0.10 |
| Stain preventing agent (equal amounts of Cpd-10, 22) | 0.014 |
| Stain preventing agent (Cpd-23) | 0.001 |
| Stain preventing agent (Cpd-12) | 0.01 |
| Coupler dispersing medium (Cpd-5) | 0.05 |
| Coupler solvent (equal amounts of Solv-4, 6) | 0.15 |
| Seventh Layer: High-Sensitive Green-Sensitive Layer | |
| Silver bromide emulsion spectrally sensitized with Green-sensitizing dyes (ExS-3, 4) (average grain size: 0.8 μm, size distribution: 16%, octahedral) | 0.10 |
| Gelatin | 0.80 |
| Magenta coupler (ExM-1, 2) | 0.11 |
| Color fading preventing agent (Cpd-9) | 0.10 |
| Stain preventing agent (equal amounts of Cpd-10, 22) | 0.013 |
| Stain preventing agent (Cpd-23) 0.001 | |
| Stain preventing agent (Cpd-12) 0.01 | |
| Coupler dispersing medium (Cpd-5) | 0.05 |
| Coupler solvent (equal amounts of Solv-4, 6) | 0.15 |
| Eighth Layer: Intermediate Layer | |
| Same as Fifth Layer | |
| Ninth Layer: Yellow Filter Layer | |
| Yellow colloidal silver | 0.20 |
| Gelatin | 1.00 |
| Color mixing preventing agent (Cpd-7) | 0.06 |
| Color mixing preventing agent solvent (equal amounts of Solv-4, 5) | 0.15 |
| Polymer latex (Cpd-8) | 0.10 |
| Tenth Layer: Intermediate Layer | |
| Same as Fifth Layer | |
| Eleventh Layer: Low-Sensitive Blue-Sensitive Layer | |
| Silver bromide emulsion spectrally sensitized with Green-sensitizing dye (ExS-5, 6) (average grain size: 0.45 μm, size distribution: 8%, octahedral) | 0.07 |
| Silver bromide emulsion spectrally sensitized with Green-sensitizing dyes (ExS-5, 6) (average grain size: 0.60 μm, size distribution: 14%, octahedral) | 0.10 |
| Gelatin | 1.50 |
| Yellow coupler (ExY-1) | 0.22 |
| Stain preventing agent (Cpd-11) | 0.001 |
| Color fading preventing agent (Cpd-6) | 0.1 |
| Coupler dispersing medium (Cpd-5) | 0.05 |
| Coupler solvent (Solv-2) | 0.05 |
| Twelfth Layer: High-Sensitive Blue-Sensitive Layer | |
| Silver bromide emulsion spectrally sensitized with blue-sensitizing dyes (ExS-5, 6) (average grain size: 1.2 μm, size distribution: 21%, octahedral) | 0.25 |
| Gelatin | 1.00 |
| Yellow coupler (ExY-1) | 0.41 |
| Stain preventing agent (Cpd-11) | 0.002 |
| Color fading preventing agent (Cpd-6) | 0.10 |
| Coupler dispersing medium (Cpd-5) | 0.05 |
| Coupler solvent (Solv-2) | 0.10 |
| Thirteenth Layer: Ultraviolet Absorbing Layer | |
| Gelatin | 1.50 |
| Ultraviolet light absorbing agent (equal amounts of Cpd-1, 3, 13) | 1.00 |
| Color mixing preventing agent (equal amount of Cpd-6, 14) | 0.06 |
| Dispersing medium (Cpd-5) | 0.05 |
| Ultraviolet light absorbing agent solvent (equal amount of Solv-1, 2) | 0.15 |

-continued

| | |
|---|---|
| Irradiation preventing dye (equal amount of Cpd-15, 16) | 0.02 |
| Irradiation preventing dye (equal amount of Cpd-17, 18) | 0.02 |
| Fourteenth Layer: Protective Layer | |
| Silver chlorobromide fine particles (silver chloride: 97 mol %, average grain size: 0.2 μm) | 0.05 |
| Acryl-modified copolymer of polyvinylalchohol (degree of modification: 17%) | 0.02 |
| Polymethyl methacrylate particles (average particle size: 2.5 μm) and silicon oxide (average particle size: 5 μm) in equal amounts) | 0.05 |
| Gelatin | 1.50 |
| Gelatin hardener (H-1) | 0.17 |
| Fifteenth Layer: Back Layer | |
| Gelatin | 2.50 |
| Sixteenth Layer: Back protective Layer | |
| Polymethyl methacrylate particles (average particle size: 2.4 μm) and silicon oxide (average particle size: 5 μm) in equal amounts) | 0.05 |
| Gelatin | 2.00 |
| Gelatin hardener (H-1) | 0.11 |

Preparation of Emulsion EMI

An aqueous solution of potassium bromide and an aqueous solution of silver nitrate were added simultaneously to an aqueous gelatin solution at 75° C. over 15 minutes while vigorously stirring, to obtain an octahedral silver bromide emulsion having an average grain size of 0.40 μm. To the emulsion were added 0.3 g of 3,4-dimethyl-1,3-thiazoline-2-thione, 4 mg of sodium thiosulfate and 5 mg of chloroauric acid (tetrahydrate) per mol of silver, and the emulsion was heated to 75° C. for 80 minutes to be chemically sensitized. The thus prepared silver bromide grains were used as cores and were further grown under the same precipitation conditions as above to obtain finally a monodispersed octahedral core/shell type silver bromide emulsion having an average grain size of 0.65 μm. The coefficient of variation of the grain size was about 10%.

1.0 mg of sodium thiosulfate and 1.5 mg of chloroauric acid (tetrahydrate) were added to the emulsion per mol of silver, and the emulsion was heated to 60° C. for 45 minutes to be chemically sensitized, thus an internal latent image type silver halide emulsion was obtained.

To each light-sensitive layer were added ExZK-1 as a nucleating agent in an amount of $1\times10^{-3}$% by weight per the coating amount of silver halide and Cpd-24 as a nucleation accelerating agent in an amount of $1\times10^{-2}$% by weight per the coating amount of silver halide.

To each layer, as emulsifying dispersing aids, Alkanol XC (manufactured by Du point) and sodium alkylbenzenesulfonate, and as coating aids, succinic acid ester and Magefac F-120 (manufactured by Dai Nippon Ink and Chemical Co., Ltd.)) were added. Furthermore, to the layers containing silver halide or colloidal silver, stabilizers (Cdp-19, 20, 21) were added. The thus-obtained photographic light-sensitive material was designated Sample 401.

The compounds used in this example are illustrated below.

ExM-1
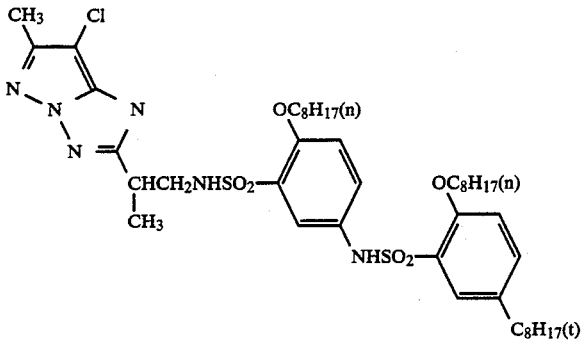
ExM-2
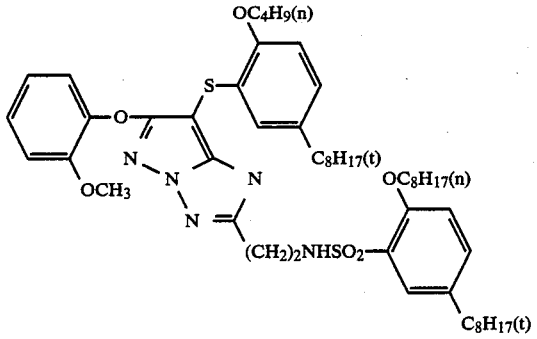
ExS-1
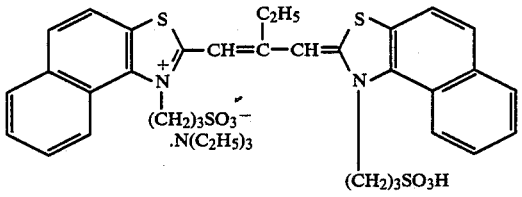
ExS-2
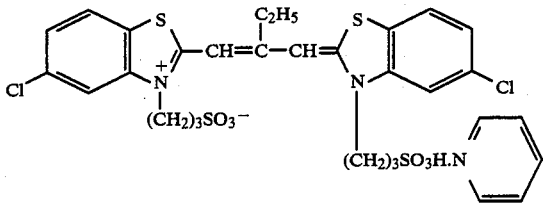
ExS-3
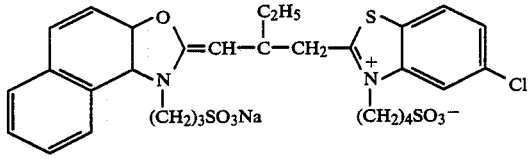
ExS-4
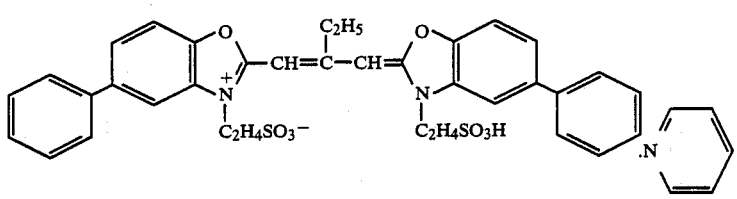

-continued
ExS-5
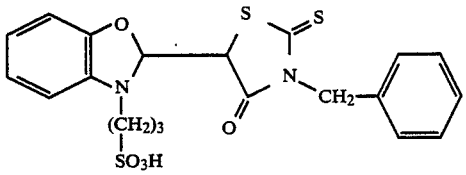
ExS-6
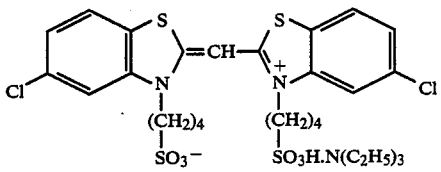
Cpd-1
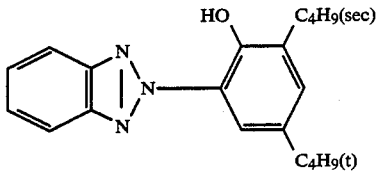
Cpd-2
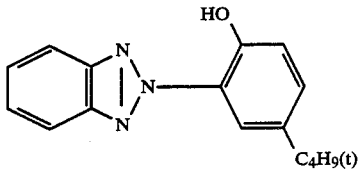
Cpd-3
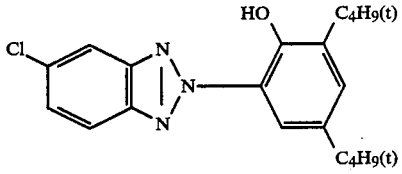
Cpd-4
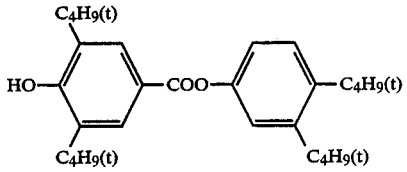
Cpd-5
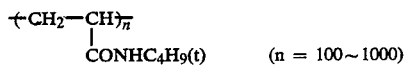
(n = 100~1000)
Cpd-6
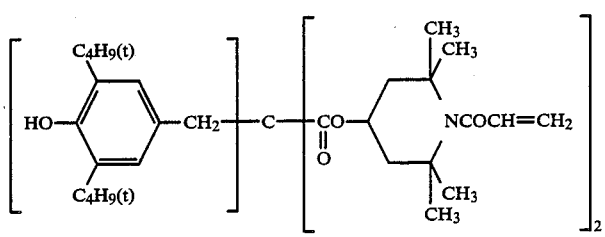
Cpd-7
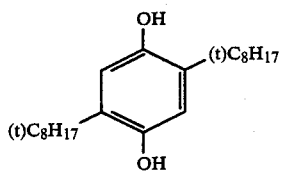
Poly(ethyl acrylate) Cpd-8

-continued
Cpd-9
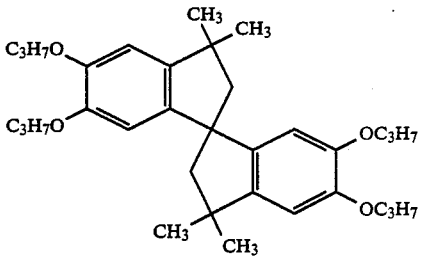
Cpd-10
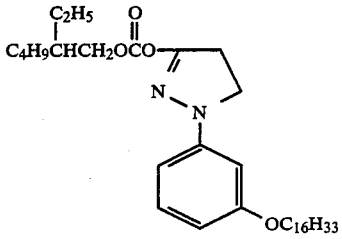
Cpd-11
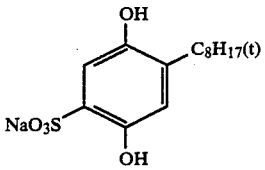
Cpd-12
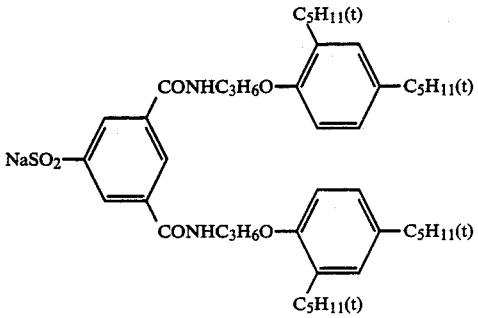
Cpd-13
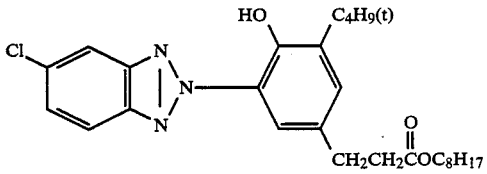
Cpd-14
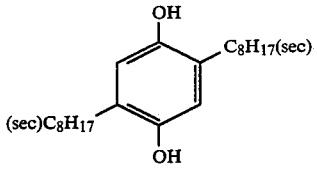
Cpd-15
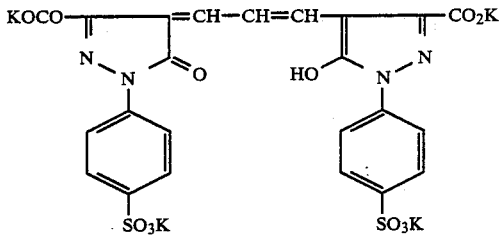

-continued
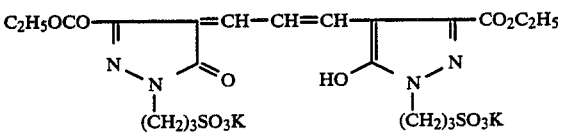
Cpd-16
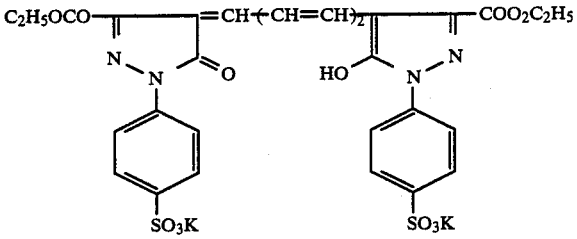
Cpd-17
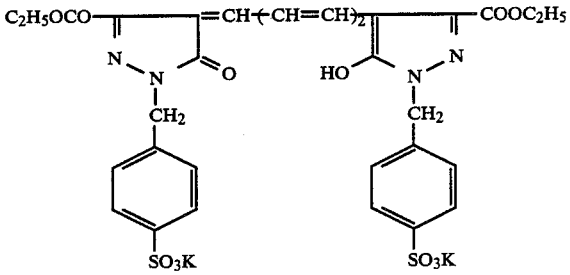
Cpd-18
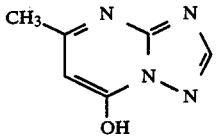
Cpd-19
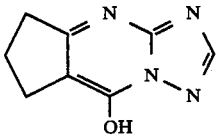
Cpd-20
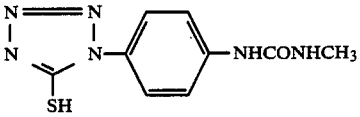
Cpd-21
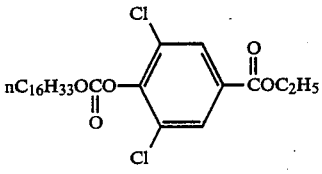
Cpd-22
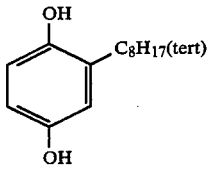
Cpd-23
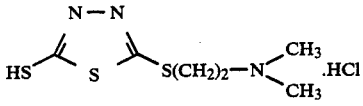
Cpd-24

-continued

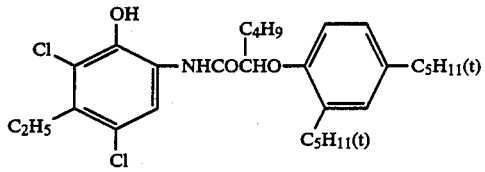

ExC-1

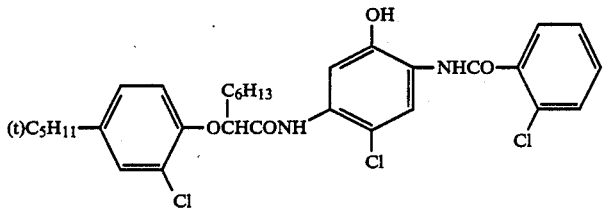

ExC-2

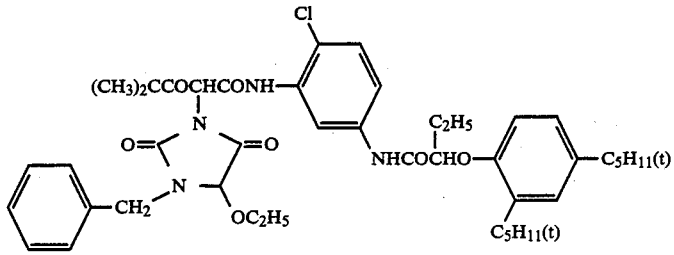

ExY-1

| | |
|---|---|
| Di(2-ethylhexyl)phthalate | Solv-1 |
| Trinonylphosphate | Solv-2 |
| Di(3-methylhexyl)phthalate | Solv-3 |
| Tricresyl phosphate | Solv-4 |
| Dibutyl phthalate | Solv-5 |
| Trioctyl phosphate | Solv-6 |
| Di(2-ethylhexyl)sebacate | Solv-7 |
| 1,2-Bis(vinylsulfonylacetamido)ethane | H-1 |
| 7-[3-(5-Mercaptotetrazol-1-yl)benzamido]-10-propargyl 1,2,3,4-Tetrahydroacridinium perchlorate | ExZK-1 |

Preparation of Samples 402 to 410

Samples 402 to 410 were prepared in the same manner as described for Sample 401 except for using the compounds shown in Table 5 below in place of the nucleating agent ExZK-1 used in Sample 401.

Samples 401 to 410 thus prepared were exposed wedgewise (1/10 sec., 10 CMS) and then subjected to development processing according to the processing steps shown below. Cyan, magenta and yellow densities of the color image formed were measured. The results thus obtained are shown in Table 5 below.

| Processing Step | Time (sec) | Temperature °C. | Amount of Replenishment (ml/m$^2$) |
|---|---|---|---|
| Color development | 80 | 38 | 260 |
| Bleach-Fixing | 30 | 38 | 260 |
| Washing with Water (1) | 30 | 38 | |
| Washing with Water (2) | 30 | 38 | 300 |

In the water washing steps, the replenishmnt magnification of washing water was 8.6 times.

The composition of the processing solutions used were as follows.

| Color Developing Solution | Tank Solution | Replenisher |
|---|---|---|
| Diethylenetriaminepenta-acetic acid | 0.5 g | 0.5 g |
| 1-Hydroxyethylidene-1,1-diphosphonic acid | 0.5 g | 0.5 g |
| Diethylene glycol | 8.0 g | 10.7 g |
| Benzyl alcohol | 9.0 g | 12.0 g |
| Sodium bromide | 0.7 g | — |
| Sodium chloride | 0.5 g | — |
| Sodium sulfite | 2.0 g | 2.4 g |
| Hydroxylamine sulfate | 2.8 g | 3.5 g |
| 3-Methyl-4-amino-N-ethyl-N-(β-methanesulfonamidoethyl) aniline sulfate | 2.0 g | 2.5 g |
| 3-Methyl-4-amino-N-ethyl-N-(β-hydroxylethyl) aniline sulfate | 4.0 g | 4.5 g |
| Potassium carbonate | 30.0 g | 30.0 g |
| Fluorescent whitening agent (stilbene type) | 1.0 g | 1.2 g |
| Pure water to make | 1,000 ml | 1,000 ml |
| pH | 10.50 | 10.90 |

The pH was adjusted with potassium hydroxide or hydrochloric acid.

| Bleach-Fixing Solution | Tank Solution | Replenisher |
|---|---|---|
| Ammonium thiosulfate | 77 g | 100 g |
| Sodium hydrogensulfite | 14.0 g | 12.0 g |
| Ammonium (ethylenediamine-tetraacetate) iron (III) dihydrate | 40.0 g | 53.0 g |
| Disodium ethylenediaminetetra-acetate dihydrate | 4.0 g | 5.0 g |
| 2-Mercapto-1,3,4-triazole | 0.5 g | 0.5 g |
| Pure water to make | 1,000 ml | 1,000 ml |

-continued

| Bleach-Fixing Solution | Tank Solution | Replenisher |
|---|---|---|
| pH | 7.0 | 6.5 |

The pH was adjusted with aqueous ammonia or hydrochloric acid.

Washing Water

Pure water was used (both Tank Solution and Replenisher).

TABLE 5

| Sample No. | Nucleating Agent No. | Nucleating Agent Amount Added (mol/mol Ag) | Relative Ratio of Nucleating Rates | Cyan $D_{max}$ | Cyan $D_{min}$ | Magenta $D_{max}$ | Magenta $D_{min}$ | Yellow $D_{max}$ | Yellow $D_{min}$ |
|---|---|---|---|---|---|---|---|---|---|
| 401 (Comparison) | ExZK-1 | $5.0 \times 10^{-6}$mol | — | 2.25 | 0.34 | 2.28 | 0.36 | 2.26 | 0.35 |
| 402 (Comparison) | N-II-25 | $2.0 \times 10^{-4}$mol | — | 1.62 | 0.17 | 1.81 | 0.18 | 1.79 | 0.19 |
| 403 (Invention) | ExZK-1/N-II-25 | $2.5 \times 10^{-6}$1/0 $\times 10^{-4}$mol | 5.2 | 2.38 | 0.15 | 2.35 | 0.16 | 2.35 | 0.16 |
| 404 (Invention) | ExZK-1/N-II-27 | " | 7.5 | 2.34 | 0.16 | 2.33 | 0.16 | 2.31 | 0.17 |
| 405 (Invention) | N-I-22/N-II-25 | " | 10.2 | 2.33 | 0.17 | 2.31 | 0.17 | 2.29 | 0.18 |
| 406 (Invention) | N-I-26/N-II-25 | " | 8.3 | 2.35 | 0.16 | 2.34 | 0.16 | 2.33 | 0.17 |
| 407 (Invention) | N-I-27/N-II-21 | " | 23.1 | 2.43 | 0.19 | 2.45 | 0.19 | 2.40 | 0.21 |
| 408 (Invention) | N-I-21/N-II-28 | " | 2.9 | 2.27 | 0.14 | 2.24 | 0.15 | 2.27 | 0.17 |
| 409 (Invention) | N-I-16/N-II-7 | " | 3.2 | 2.32 | 0.16 | 2.30 | 0.18 | 2.27 | 0.18 |
| 410 (Invention) | N-I-9/N-II-14 | " | 6.7 | 2.26 | 0.17 | 2.31 | 0.17 | 2.30 | 0.18 |

From the results shown in Table 5 above, it is apparent that the samples according to the present invention exhibit extremely preferred results in that they have high Dmax and low Dmin in comparison with the comparison samples.

While the invention has been described in detail and with reference to specific embodiments thereof, it will be apparent to one skilled in the art that various changes and modifications can be made therein without departing from the spirit and scope thereof.

What is claimed is:

1. A direct positive image forming method comprising development processing an imagewise exposed photographic light-sensitive material comprising a support having thereon at least one photographic emulsion layer containing internal latent image type silver halide grains not having been previously fogged in the presence of a nucleating agent, wherein the nucleating agent comprises at least two kinds of nucleating agents and the ratio of nucleating rates thereof is at least 2.0.

2. A direct positive image forming method as claimed in claim 1, wherein the ratio of nucleating rates is form 2 to 10,000.

3. A direct positive image forming method as claimed in claim 2, wherein the ratio of nucleating rates is from 3 to 5,000.

4. A direct positive image forming method as claimed in claim 3, wherein the ratio of nucleating rates is from 4 to 1,000.

5. A direct positive image forming method as claimed in claim 1, wherein the nucleating agents are selected from the compounds represented by the general formulae [N-I] and [N-II]:

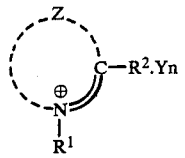

(N-I)

wherein Z represents a non-metallic atomic group necessary for forming a substituted or unsubstituted 5-membered or 6-membered heterocyclic ring; $R^1$ represents a substituted or unsubstituted aliphatic group, $R^2$ represents a hydrogen atom, a substituted or unsubstituted aliphatic group, or a substituted or unsubstituted aromatic group; provided that at least one of $R^1$, $R^2$ and Z contains an alkynyl group, an acyl group, a hydrazine group or a hydrazone group, or $R^1$ and $R^2$ together form a 6-membered ring to complete a dihydropyridinium skeleton; Y represents a counter ion necessary for charge balance; and n is 0 or 1; (a) at least one of the substituents of (b) $R^1$, $R^2$ and Z may contain the group $X^1$ $(L^1)_m$, in which $X^1$ represents a group capable of accelerating absorption onto a silver halide grain, $L^1$ represents a divalent linking group and m is 0 or 1;

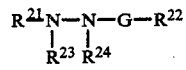

(N-II)

wherein $R^{21}$ represents an aliphatic group, an aromatic group or a heterocyclic group; $R^{22}$ represents a hydrogen atom, an alkyl group, an aralkyl group, an aryl group, an alkoxy group, an aryloxy group or an amino group; G represents a carbonyl group, a sulfonyl group, a sulfoxy group, a phosphoryl group or an iminomethylene group

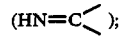

and $R^{23}$ and $R^{24}$ both represent a hydrogen atom, or one of $R^{23}$ and $R^{24}$ represents a hydrogen atom and the other represents an alkylsulfonyl group, an arylsulfonyl group or an acyl group and G, $R^{23}$ and $R^{24}$ together with the hydrazine nitrogens may form a hydrozone structure

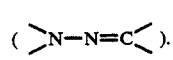

6. A direct positive image forming method as claimed in claim 1, wherein the nucleating agents are present in the photographic light-sensitive material.

7. A direct positive image forming method as claimed in claim 6, wherein the nucleating agents are present in an internal latent image type silver halide emulsion layer.

8. A direct positive image forming method as claimed in claim 1, wherein the nucleating agents are present in a processing solution.

9. A direct positive image forming method as claimed in claim 1, wherein the internal latent image type silver halide emulsion is a core/shell type silver halide emulsion.

10. A direct positive image forming method as claimed in claim 1, wherein the photographic light-sensitive material contains a color coupler.

11. A direct positive image forming method as claimed in claim 10, wherein the imagewise exposed photographic light-sensitive material is subjected to development with a surface developer containing an aromatic primary amine color developing agent after or during a fogging treatment by means of light or a nucleating agent, followed by bleach processing and fixing processing.

12. A direct positive image forming method as claimed in claim 11, wherein a pH of the color developing solution is not more than 11.5.

13. A direct positive image forming method as claimed in claim 1, wherein the photographic light-sensitive material further contains a nucleation accelerating agent.

14. A direct positive image forming method as claimed in claim 13, wherein the nucleation accelerating agent is present in an internal latent image type silver halide emulsion layer or a layer adjacent thereto.

15. A direct positive image forming method as claimed in claim 1, wherein a nucleation accelerating agent is present in a processing solution.

16. A direct positive image forming method as claimed in claim 15, wherein the nucleation accelerating agent is present in a developing solution or a bath prior thereto.

* * * * *